US009852718B1

(12) United States Patent
Kelly

(10) Patent No.: US 9,852,718 B1
(45) Date of Patent: Dec. 26, 2017

(54) MODULAR GUITAR BODY

(71) Applicant: Dan Kelly, Des Moines, IA (US)

(72) Inventor: Dan Kelly, Des Moines, IA (US)

( * ) Notice: Subject to any disclaimer, the term of this patent is extended or adjusted under 35 U.S.C. 154(b) by 0 days.

(21) Appl. No.: 15/266,701

(22) Filed: Sep. 15, 2016

(51) Int. Cl.
*G10D 1/08* (2006.01)

(52) U.S. Cl.
CPC ..... *G10D 1/085* (2013.01)

(58) Field of Classification Search
CPC ..... G10D 1/08; G10D 1/085; G10D 1/00
See application file for complete search history.

(56) References Cited

U.S. PATENT DOCUMENTS

| | | | | |
|---|---|---|---|---|
| 4,144,793 | A | 3/1979 | Soika et al. | |
| 4,741,238 | A | 5/1988 | Carriveau | |
| 6,011,205 | A | 1/2000 | Tucker et al. | |
| 6,255,567 | B1 | 7/2001 | Minakuchi | |
| 6,646,189 | B2 | 11/2003 | Minakuchi | |
| 7,507,885 | B2 | 3/2009 | Coke | |
| 8,558,096 | B2 | 10/2013 | Aitheim | |
| 8,957,292 | B2 | 2/2015 | Zeren | |
| 9,165,539 | B2 | 10/2015 | Ostosh | |
| 9,208,756 | B2 | 12/2015 | Isaac | |
| 2005/0284281 | A1 | 12/2005 | Suyama | |
| 2008/0105101 | A1 * | 5/2008 | Eldring | G10D 1/085 84/291 |
| 2008/0202310 | A1 | 8/2008 | Coke | |
| 2011/0219932 | A1 | 9/2011 | Gembar | |
| 2011/0232458 | A1 | 9/2011 | Aitheim | |
| 2014/0311315 | A1 | 10/2014 | Isaac | |

* cited by examiner

*Primary Examiner* — Kimberly Lockett
(74) *Attorney, Agent, or Firm* — Greenblum & Bernstein, P.L.C.

(57) ABSTRACT

A stringed instrument body includes a top body having a groove/shelf engagement structure, and a back body having a corresponding shelf/groove engagement structure that is engagable with the groove/shelf engagement structure of the top body. When the corresponding shelf/groove engagement structure is engaged with the groove/shelf engagement structure, a projecting portion of the groove/shelf engagement structure of the top body projects within the back body and contacts a corresponding recessed portion of the shelf/groove engagement structure of the back body.

30 Claims, 19 Drawing Sheets

Top View

MODULAR GUITAR BODY

BACKGROUND OF THE DISCLOSURE

1. Field of the Disclosure

This disclosure relates to a guitar body, and more particularly, to a modular multiple-piece guitar body designed to be modifiable and/or customizable.

2. Description of the Related Art

The Fender® Telecaster® (or Tele®), is the world's first commercially successful solid-body electric guitar, and was introduced for national distribution (as the Broadcaster) in the autumn of 1950. In its classic form, the guitar is simply constructed, with the neck and fingerboard (or fret board) comprising a single piece of maple, screwed to an ash or alder body inexpensively jigged with flat surfaces on the front and back. The hardware includes two single coil pickups controlled by a three-way selector switch, and one each of volume and tone controls. The bridge has three adjustable saddles, with strings doubled up on each.

For the most part, the design of the electric guitar body has changed very little over the last 65 years. Leo Fender selected a 1.75" thick piece of wood for his Telecaster and that eventually became the accepted, "standard" thickness for a solid body electric guitar body. The Telecaster's design also helped establish the "standard" guitar neck pocket depth (for a bolt-on neck guitars), as well as the way in which the pickups are mounted in routed cavities. At that time, the electronics for most guitars were accessed below pickguards (Fender®-style) or via control cavities (Gibson®-style). Modifying a guitar was not a common occurrence when the iconic Telecaster® was first launched. In the early 1950s, for example, there were few after-market options if a player wanted to change their pickups or modify the wiring.

Today, many electric guitar players want to modify their guitars and there are, for example, countless boutique pickup builders providing alternatives to the factory installed stock parts. Many players frequently swap out their guitar electronics and pickups in the never-ending pursuit of achieving the "ultimate" tone.

For example, many musicians seek the capability to create a very particular sound or "tone" and will go to great lengths and/or expense in order to produce such tone. Oftentimes the emulation of a particular tone, or in some cases, the ability to create new sounds is desired. In the context of the electric guitar, many factors contribute to the sound of the instrument such as, for example, the type and quality of body material, stress state of the material, and type of transducer or pickup (e.g., magnetic or piezo) used.

To meet the demand of "mod" (or modification) hungry guitarists, there are currently hundreds of "boutique" guitar part manufacturers providing custom pickups, necks and other guitar hardware (e.g., tuners, switches, bridges, saddles, etc.). However, most guitar bodies have held true to their 1950's era design origins, and thus, are constrained in their modification-ability (or modifiability) and/or customizability. That is, a "traditional" electric guitar body has many shortcomings for a player wanting to modify it.

Traditional guitar bodies, for example, can limit a player's ability to customize their guitar in several ways. Examples of these limitations include: the pickup location being limited to where the routing is situated on the top of the guitar; the scale length of the neck that can be used with the guitar body is pre-defined by where the drilled holes are located for the bridge; and the volume/tone controls are restricted to a small routed area on the back of the guitar (Gibson style) or fastened to a plastic pickguard (Fender style). For example, when a guitar has pickup cavities, pickups need to be placed exactly where the pickup cavities are located. Additionally, with traditional guitar bodies, switches need to be positioned exactly where the pre-routed switch cavity is located on a guitar body. Moreover, with some guitars, pickguards need to be removed before performing any wiring updates, and trial pickup combinations cannot be tested until all the parts of the guitar are put back in place (i.e., until the guitar is fully reassembled. Thus, with traditional guitar bodies, an A/B comparison between the various alternative parts is difficult, as disassembly and subsequent reassembly is required between each sound test. All these restrictions encountered with known guitar designs prevent or limit modification of a guitar to a users' preferences.

Therefore, there is a need in the industry for an improved guitar body that can more easily be modified and/or customized, and which can more easily be tested when comparing alternative modifications.

SUMMARY OF THE EMBODIMENTS OF THE DISCLOSURE

Aspects of the present disclosure are directed to a stringed instrument body, comprising a top body having a groove/shelf engagement structure and a back body having a corresponding shelf/groove engagement structure that is engagable with the groove/shelf engagement structure of the top body. When the corresponding shelf/groove engagement structure is engaged with the groove/shelf engagement structure, a projecting portion of the groove/shelf engagement structure of the top body projects within the back body and contacts a corresponding recessed portion of the shelf/groove engagement structure of the back body.

In additional embodiments, the top body has an approximate thickness of 1.25".

In further embodiments, the top body has an approximate thickness of 1.25", the back body has an approximate thickness of 0.75", and when the top body is joined to the back body to form the stringed instrument body, the overall thickness of the stringed instrument body is less than 2.0".

In yet further embodiments, the top body has an approximate thickness of A, the back body has an approximate thickness of B, and when the top body is joined to the back body to form the stringed instrument body, the overall thickness of the stringed instrument body is less than A+B.

In embodiments, the back body is interchangeable with a different back body having a different thickness and/or different materials so as to modify one or more properties of the stringed instrument body.

In additional embodiments, the back body is removably fastenable to the top body.

In further embodiments, the stringed instrument body further comprises an edging arranged at the junction of the top body and back body along the perimeter of the stringed instrument body.

In yet further embodiments, the edging covers a seam between the top body and the back body so as to provide an appearance of a single-piece body construction.

In certain embodiments, the edging is arranged on the top body and arranged to cover a larger portion of the top body than the back body, such that the top body and the back body appear to have approximately equal thicknesses.

In some embodiments, both the top body and the back body comprise wood.

In further embodiments, the top body and the back body each comprise a different species of wood.

In embodiments, the top body provides a blank-canvas mounting surface for one or more guitar components.

In certain embodiments, the top body includes a tone block extending along the length of the top body on an inner side of the top body, and projects along a length of the tone block to a same height in a thickness direction of the top body as a height of a raised groove of the groove/shelf engagement structure.

In additional embodiments, the back body includes a corresponding tone block on an inner side of the back body, and when the top body and the back body are joined together, the tone block of the top body is in contact with the corresponding tone block of the back body.

In further embodiments, the tone block of the top body includes a recessed region structured and arranged to accommodate a neck plate and fasteners.

In yet further embodiments, the back body includes a tone block extending along the length of the back body on an inner side of the back body, and projects along a length of the tone block to a same height in a thickness direction of the back body as a height of a recessed shelf of the shelf/groove engagement structure.

In embodiments, the top body and the back body have congruent profiles.

In additional embodiments, inner sides of at least one of the top body and the back body include one or more hollowed regions.

In further embodiments, the stringed instrument body further comprises at least one removable insert structured and arranged to be insertable into a hollowed region of the one or more hollowed regions.

In yet further embodiments, the stringed instrument body further comprises a neck plate arranged on an inner side of the top body, and structured and arranged for securing a bolt-on neck to the top body.

In embodiments, when the back body is attached to the top body, the neck plate is covered by the back body, such that the neck plate is internal to the stringed instrument body and hidden from view.

In additional embodiments, the inner side of the top body includes a recessed region structured and arranged to accommodate the neck plate.

In certain embodiments, the back body includes a sculpted region in a neck joint area covering the neck plate.

In yet further embodiments, the shelf/groove engagement structure of the top body is arranged along the perimeter of the top body, and the shelf/groove engagement structure of the back body is arranged along the perimeter of the back body.

In certain embodiments, the top body comprises a neck pocket having a depth D of approximately 0.31" and a length L of between approximately 3.2" and 3.5".

In additional embodiments, when a neck having a fret board with an approximate height of 1.0" is arranged in the neck pocket, a top surface of the neck is raised above a top surface of the top body by approximately 0.70"-0.90".

In some embodiments, the top body comprises a neck pocket having a length L of approximately 3.2" to 3.5" and a depth D that varies between approximately 0.236" (6 mm) and 0.334" (8.5 mm) along the length of the neck pocket.

In certain embodiments, the stringed instrument body further comprises a bridge assembly having a bridge, mounting posts, and respective stands having conical profile.

Aspects of the present disclosure are directed to a stringed instrument, comprising: a stringed instrument body having a body thickness, the stringed instrument body comprising a top body, and a back body removably fastenable to the top body and providing a portion of the body thickness, a neck attached to the top body, and a plurality of strings attached to the neck and the stringed instrument body. The top body is a playable instrument even while the back body is not attached to the top body.

Additional aspects of the present disclosure are directed to a stringed instrument body, comprising: a top body having a groove/shelf engagement structure; a neck plate arranged on an inner side of the top body, and structured and arranged for securing a bolt-on neck to the top body; and a back body having a corresponding shelf/groove engagement structure that is engagable with the groove/shelf engagement structure of the top body. The back body is removably fastenable to the top body. When the corresponding shelf/groove engagement structure is engaged with the groove/shelf engagement structure, a projecting portion of the groove/shelf engagement structure of the top body projects within the back body and contacts a corresponding recessed portion of the shelf/groove engagement structure of the back body. When the back body is engaged with the top body, the neck plate is covered by the back body, such that the neck plate is hidden from view. The top body has an approximate thickness of A, the back body has an approximate thickness of B, and when the top body is joined to the back body to form the stringed instrument body, the overall thickness of the stringed instrument body is less than A+B.

BRIEF DESCRIPTION OF THE DRAWINGS

The novel features which are characteristic of the embodiments of the disclosure, both as to structure and method of operation thereof, together with further aims and advantages thereof, will be understood from the following description, considered in connection with the accompanying drawings, in which embodiments of the disclosure are illustrated by way of example. It is to be expressly understood, however, that the drawings are for the purpose of illustration and description only, and they are not intended as a definition of the limits of the disclosure. For a more complete understanding of the disclosure, as well as other aims and further features thereof, reference may be had to the following detailed description of the embodiments of the disclosure in conjunction with the following exemplary and non-limiting drawings wherein.

Figure 1:
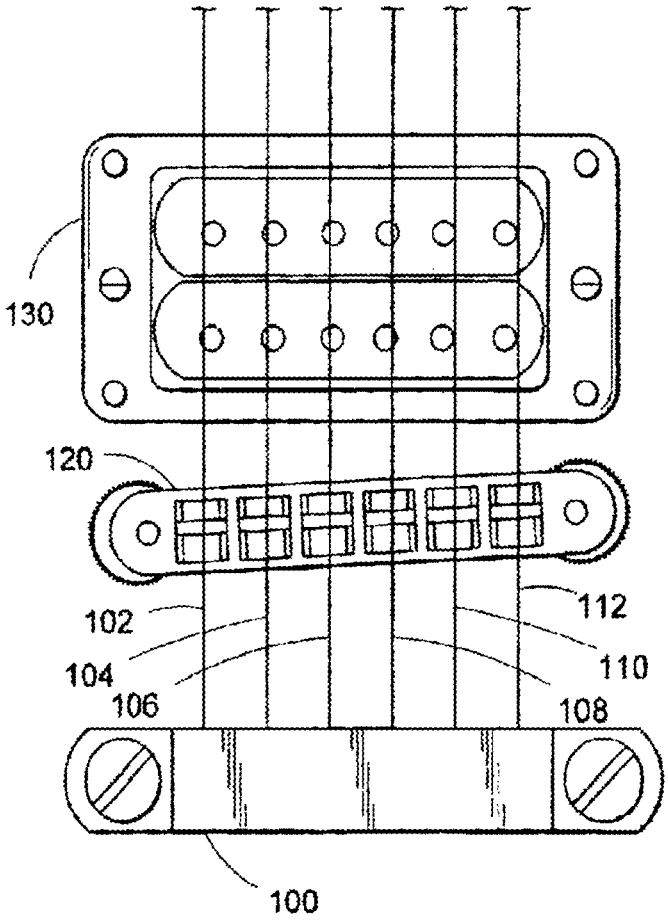
FIG. 1 (Prior Art)
FIG. 1 is a top view of a conventional guitar upon which a guitar bridge is mounted.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely.

The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

FIG. 1 is a top view of a conventional guitar upon which a guitar bridge is mounted. As shown in FIG. 1, a tailpiece 100 is mounted on a body of an exemplary 6-string guitar and holds one end of strings 102, 104, 106, 108, 110, and 112. A tailpiece 100 provides the mechanical strength for the tension of the stretched strings against the body of the guitar. These strings 102, 104, 106, 108, 110, and 112 then pass over a bridge 120, which is used to initially set the tuning of the guitar so the guitar plays in tune with the proper tone and timbre. The bridge includes a number of saddles (e.g., one or two for each string), wherein each string passes (or two strings pass) over a respective saddle. Each saddle may be similarly constructed and may include one or more notches, through which the string passes to hold its respective string above the bridge and guitar at a desired height. The position of each saddle (within the bridge) along the length of the guitar (i.e., in a string extension direction) may be altered to adjust the intonation of each string.

As shown in FIG. 1, in an electric guitar, the strings 102, 104, 106, 108, 110, and 112 will also pass over one or more magnetic or other types of pickups 130. The pickups 130 are used to convert the physical vibrations of the strings 102, 104, 106, 108, 110, and 112 into electrical signals that can then be electrically amplified.

The strings 102, 104, 106, 108, 110, and 112 then extend over, but do not contact, multiple frets (not shown) on the guitar. Towards a neck end of the guitar, the strings 102, 104, 106, 108, 110, and 112 then pass over a nut (not shown) to tuning pegs (not shown). The tuning pegs are adjustable to increase or decrease the tension of each respective string 102, 104, 106, 108, 110, and 112. This raises or lowers the frequency of the pitch of each string so that the proper notes are heard upon plucking or strumming the guitar. Between the nut and the bridge 120 are the various frets between which the strings 102, 104, 106, 108, 110, and 112 are depressed so that the effective length of the string is shortened to thereby increase the frequency at which that particular string vibrates.

An important factor in a quality electric guitar is the guitar sound. The material of the body, the quality of the magnetic or other pickups (e.g., piezo pickups), the rigidity of the guitar itself, the accuracy of the placement and spacing of the strings 102, 104, 106, 108, 110, and 112 above the fingerboard and associated frets, the actual placement of the frets, and the quality of the tuning bridge 120 are all important to the overall sound of the guitar.

Figure 2:
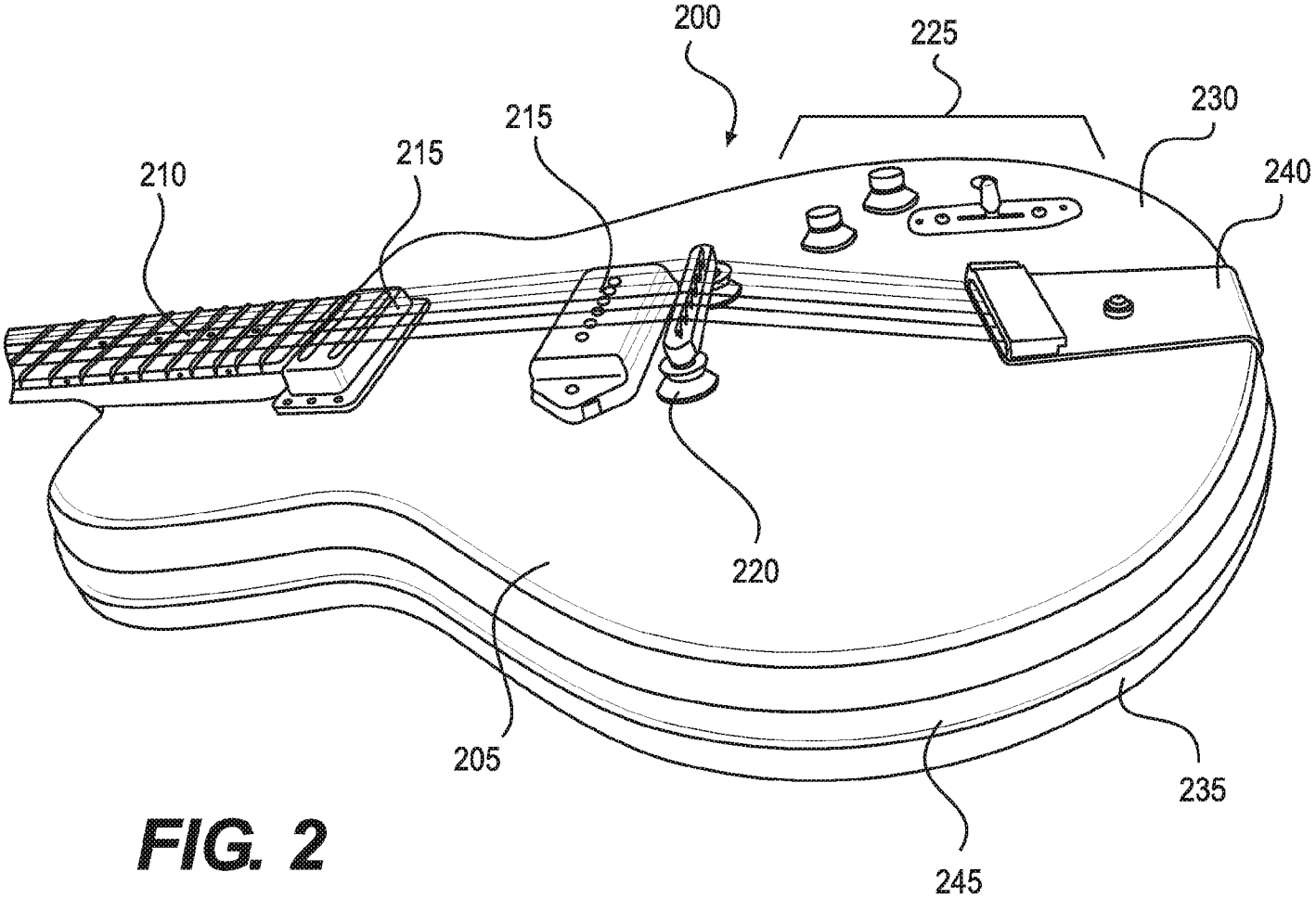
FIG. 2 shows an exemplary and non-limiting depiction of a guitar body in accordance with aspects of the disclosure.

FIG. 2 shows an exemplary and non-limiting depiction of a guitar 200 in accordance with aspects of the disclosure. Aspects of the disclosure are directed to a guitar body having a top body and a removable back attached to the top body to form the guitar body. In accordance with aspects of the disclosure, the improved guitar body may more easily be modified, e.g., with a desired combination and/or location of pickups, with a desired combination and/or location of electronics, with a desired neck, and/or other hardware, and is more easily tested when comparing alternative modifications.

By implementing aspects of the disclosure, the modular guitar body accepts a vast array of guitar parts and allows, for example, various scale length necks, different style pickups and electronics, as well as pickup and electronics location versatility. With the present disclosure, the highly customizable guitar is achieved while being aesthetically pleasing (for example, the guitar does not have an oversized plastic control cover on the back). In accordance with further aspects of the disclosure, when the back body of the guitar is removed the guitar is still playable. Thus, a user can swap parts (e.g., potentiometers, capacitors, pickups) quickly, allowing the player to quickly and easily hear the difference between a humbucker pickup, P-90 pickup or a single coil pickup, for example, on the guitar, or how a 0.022 cap (or capacitor) sounds different from a 0.047 cap. In other words, in accordance with aspects of the disclosure, the removable back design allows the guitar to still be played while adjustments are being made.

Two-Piece Top/Back Body Structure

As shown in FIG. 2, the guitar 200 includes a guitar body 205 and a neck 210. A plurality of pickups 215, a bridge 220, a plurality of actuators 225 (e.g., potentiometers and/or switches), and a tailpiece 240 are arranged on the guitar body 205. In accordance with further aspects of the disclosure, in embodiments, the guitar body 205 comprises a top body 230 and a back body 235, which is removably fastenable (e.g., using screws) to the top body 230.

Figure 3:
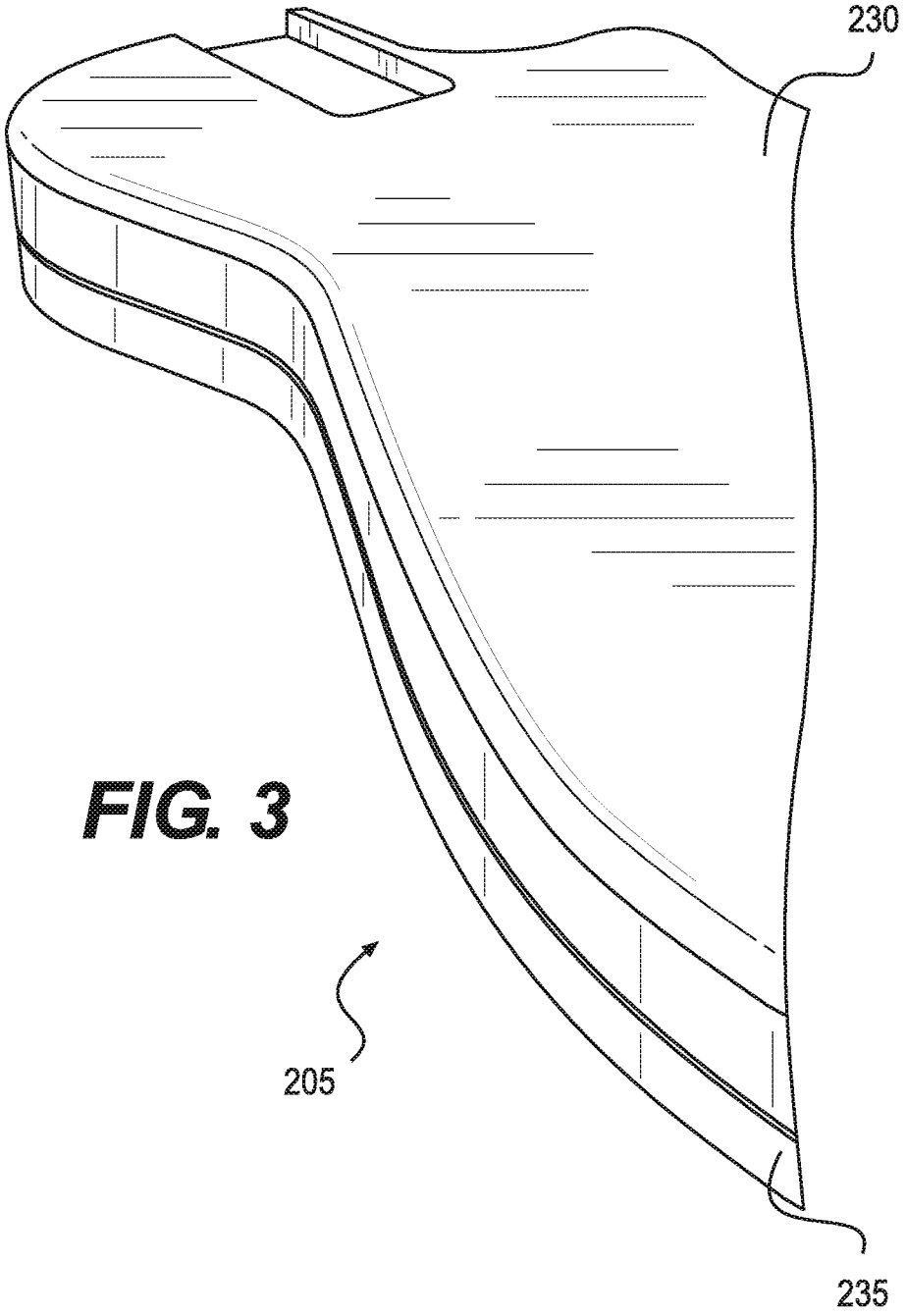
FIG. 3 shows a view of the top body and the back body joined together to form the guitar body.

FIG. 3 shows a view of the top body 230 and the back body 235 joined together to form the guitar body 205. As shown in FIG. 3, in embodiments, the guitar 200 includes a top (or "front") body 230 and back (or "bottom") body 235. In an exemplary and non-limiting embodiment, the top body 230 accounts for roughly ⅔ of the overall guitar body thickness, and the back body 235 accounts for roughly ⅓ of the overall guitar body thickness.

Through experimentation, the inventor has found that a top body 230 having an approximate thickness of 1.25" provides adequate stiffness and support for a bolt-on neck, which is attached thereto. Cutting a traditional 1.75" thick guitar body in half results in two halves each with a thickness of 0.875". The inventor has found that a thickness of 0.875", however, would not provide enough support for the guitar's string tension when completed. Thus, with the present disclosure, the top body 230 has an approximate thickness of 1.25", which provides adequate stiffness and support for a bolt-on neck, which is attached thereto, as discussed below.

A traditional bolt-on neck guitar body is made from a single piece of 1.75" thick wood. With an exemplary and non-limiting embodiment, the guitar body 205 includes a top body 230 having an approximate thickness of 1.25" thick piece of wood and a back body 235 having an approximate thickness of 0.75". As discussed below, the top body 230 and the back body 235 respectively include grooves and shelves structured and arranged thereon to allow a portion of the top body 230 to project into the interior of the back body 235 (or vice versa) when the two pieces are assembled together. Due to the guitar body's groove and shelf design, when the two parts are joined together, the guitar body's overall thickness is approximately 1.82" (and not the sum of the respective thicknesses, i.e., 1.25"+0.75"=2.0"). Thus, in accordance with aspects of the disclosure, when assembled, the guitar body 205 has a thickness that is similar to a traditional bolt-on neck guitar body made from a single piece of 1.75" thick wood. Moreover, as the back body 235 has an approximate thickness of 0.75", and the overall thickness of the guitar body 205 is approximately 1.82", the back body 235 is roughly ⅓ of the guitar body thickness (e.g., 0.75/1.82=41%). In other contemplated embodiments, the overall thickness of the guitar body 205 may range between approximately 1.8" and 1.9".

While it is described above that, in embodiments, the top body 230 accounts for roughly ⅔ of the overall guitar body thickness, and the back body 235 accounts for roughly ⅓ of the overall guitar body thickness, it should be understood, however, that "⅓" and "⅔" should not be construed as limiting the embodiments of the disclosure, and that the disclosure contemplates other thickness (e.g., back body thickness) that would alter the roughly ⅓ to ⅔ relationship. For example, with some embodiments, the back body may have a thickness approximately equal to the top body, such that the ratio is closer to ½ to ½.

Figure 4:
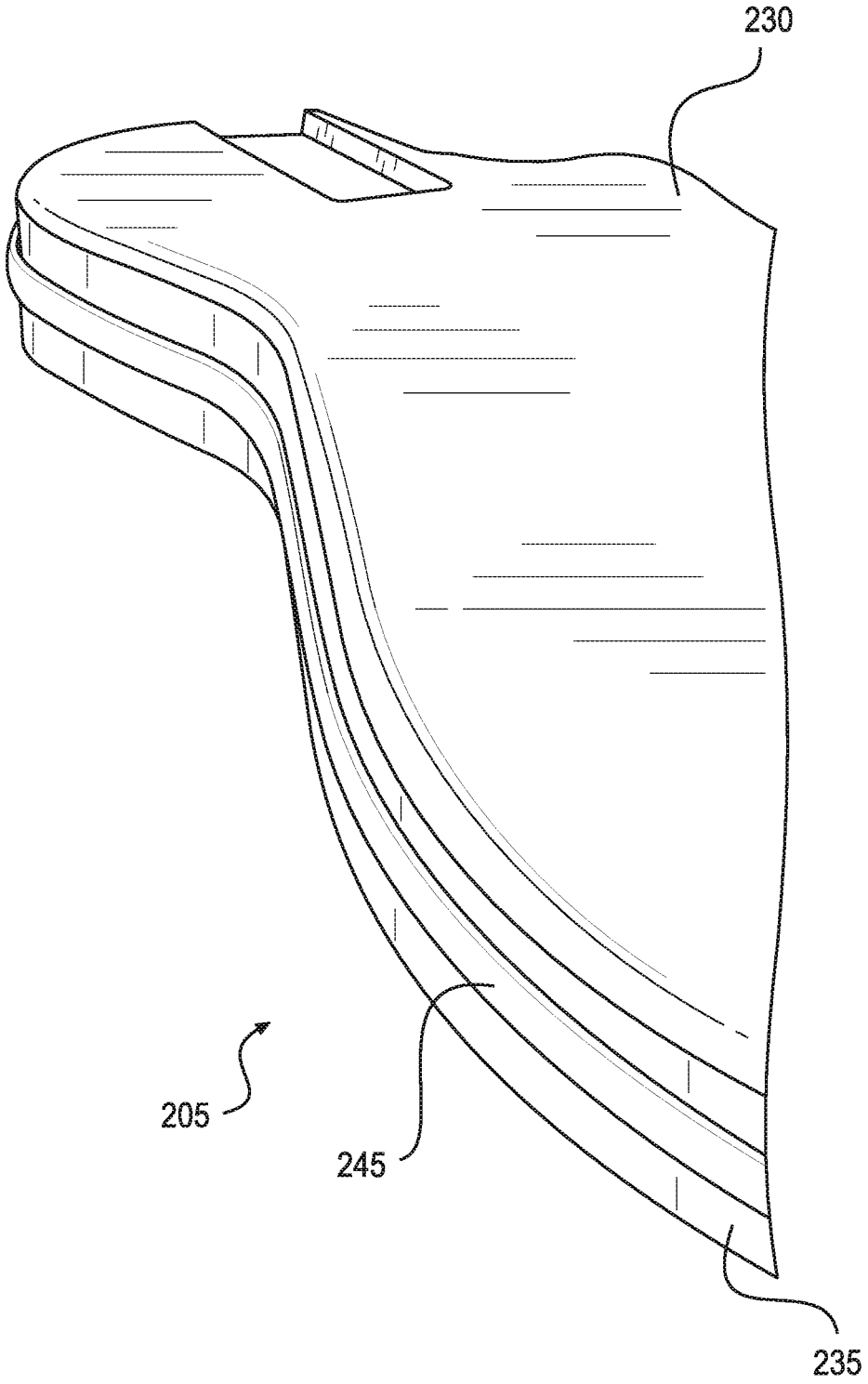
FIG. 4 shows a view of the top body and the back body joined together to form the guitar body with a binding (or decorative edging) in accordance with aspects of the disclosure.

FIG. 4 shows a view of the top body 230 and the back body 235 joined together to form the guitar body 205 with a binding 245 (or decorative edging) in accordance with aspects of the disclosure. The binding 245 is arranged at the junction of the top body 230 and the back body 235 and conceals the visual separation of the top body 230 and the back body 235. That is, in accordance with aspects of the disclosure, the existence of a two-piece structure of the top body 230 and the back body 235 is "hidden," in that a junction or seam between the top body 230 and the back body 235 is covered with a binding 245. When the junction or seam is covered with the binding 245, the guitar body 205, while comprising a top body 230 and a back body 235, has the appearance of a single-piece body construction. As shown in FIGS. 2 and 4, the binding 245 breaks the visual separation of the two pieces of wood. Thus, in accordance with aspects of the disclosure, from a side profile it appears that the exemplary guitar body 205 of FIG. 2 is made from a single solid piece of wood. It should be understood that the binding 245 is not structured and arranged to "bind" the top body 230 to the back body 235, as the back body 235 is removably connectable to the top body 230 using a plurality of fasteners, in accordance with aspects of the disclosure.

Moreover, as shown in the exemplary embodiment of FIG. 4, the binding 245 may be arranged on the top body 230 in such a manner that it appears (in comparison to FIG. 3) that the top body 230 and the back body 235 are of equal thickness. For example, in embodiments, the guitar body utilizes a binding 245 positioned on the lower edge of the top body 230. When applied, the binding 245 covers the seam where the two parts meet. Moreover, in embodiments, the binding 245 may be arranged to cover a larger portion of the top body 230 than the back body 235, such that it appears (in comparison to FIG. 3) that the top body 230 and the back body 235 are of equal thickness. In other contemplated embodiments, for example, having a back body that is as thick as the top body, the arrangement of the binding may be shifted so that the binding 245 appears to be centered on the guitar in a thickness direction. In certain embodiments, the binding 245 may be moveable so as to allow a user to shift the binding 245, for example, when using a differently-sized back body. In further embodiments, the binding 245 may be differently sized (e.g., different thickness), so as to provide the appearance that the top body and the back body are of equal thickness when a thicker back body is utilized. In embodiments, the binding may comprise metal, a plastic or polymer, and/or wood, amongst other contemplated materials. Additionally, while the disclosed embodiments utilize a binding 245 attached to the top body, in embodiments, depending on the relative thickness of the back body, the inventor contemplates embodiments having the binding arranged on the back body.

The binding 245 is different from other guitar designs that utilize a side binding. Traditionally, a binding of this type has been used to permanently join two pieces of wood or fiberglass, or simply for ornamentation. In accordance with aspects of the disclosure, however, the binding 245 helps "hide" the seam that provides access to the inside of the guitar (or the backside of the top body 230), providing easy access to the electronics and/or internal components.

As discussed further below, in accordance with aspects of the disclosure, the top body 230 is playable even while the back body 235 is removed, e.g., to allow adjustments to be made to the electronics when the back body 235 is removed. In an exemplary and non-limiting embodiment, five screws may be used to attach the back body 235 to the top body 230 so as to join the two body parts to form the guitar body 205.

In embodiments, both the top body 230 and the back body 235 are made from wood. In embodiments, the top body 230 and the back body 235 may be made from the same species of wood. In other embodiments, the top body 230 and the back body 235 may be made from different species of wood. In yet additional embodiments, the top body 230 may be made of wood, while the back body 235 is made from a different material (e.g., plastic, metal, composite, or carbon-fiber). In some embodiments, the top body may comprise a wood laminate, for example, of different wood species. For example, the top surface of the top body 230 may be maple, whereas the remaining portions of the top body (e.g., the sides and, in embodiments, a portion of the top) may be korina.

As shown in FIG. 3, in accordance with aspects of the disclosure, in certain embodiments, the top body 230 (except for the region of the neck pocket) provides a mounting surface for guitar components that is a "blank canvas." For example, in embodiments, the top body 230 does not include cavities for arranging pickups therein, such that a user may arrange the desired pickups in a variety of locations. Additionally, the top body 230 does not include a pre-formed or fixed bridge mounting position, such that, for example, the user is able to arrange the bridge on the top body 230 in a variety of positions so as to provide, for example, proper intonation based on the scale of the neck utilized. While embodiments are described as having no cavities, as discussed below, the inventor contemplates that, in some embodiments, the top body 230 may include some cavities, for example, structured and arranged to accommodate pickups. Additionally, with such embodiments, the guitar body may include respective caps (or plugs) that are sized to fill the cavities if they are not needed for a current desired instrument configuration. In embodiments, the caps may be made of the same species of wood as the top body, or may be a different species of wood or some other suitable material.

Surface mounted guitars, that is, guitars having, for example, surface-mounted pickups, are known including, for example, archtops having the electronics added to the top via a surface mount configuration or attached to a "floating" pickguard. Guitars having traditional surface mount pickups, however, have design limitations. With fiberglass guitars, for example, removing the back was often difficult due to the binding that was used. Additionally, wooden guitars were not built with maximum modifications in mind.

Figure 5:
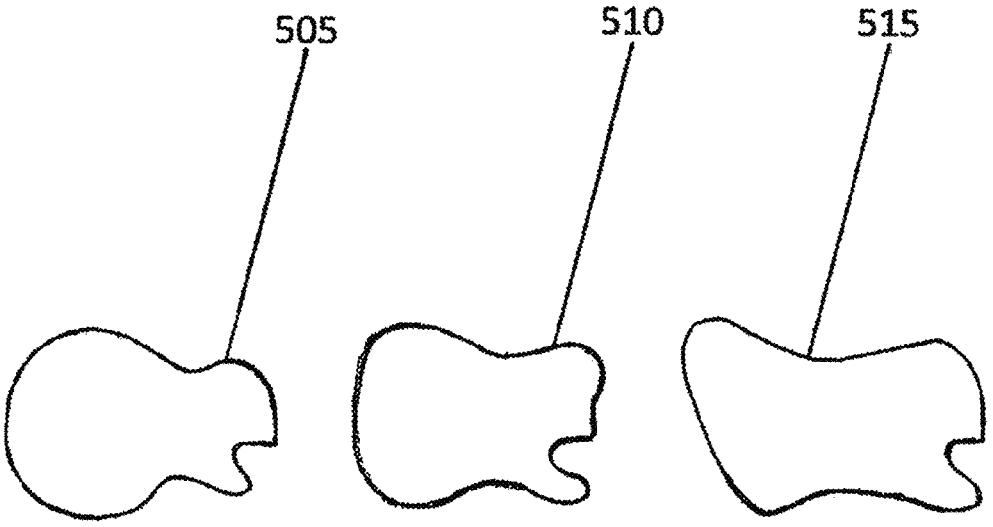
FIG. 5 shows exemplary various guitar body shapes for which the present disclosure may be utilized in accordance with aspects of the disclosure.

It should be understood that while the exemplary embodiment has a particular guitar shape (e.g., outer profile), the two-part body system of the present disclosure is applicable to a variety of guitar shapes. For example, FIG. 5 shows exemplary various guitar body shapes 505, 510, and 515 for which the present disclosure may be utilized in accordance with aspects of the disclosure. While FIG. 5 shows exemplary various guitar body shapes for which the present disclosure may be utilized, it should be understood that that the present disclosure is not limited to these exemplary various guitar body shapes.

Swappable Back Bodies

Figure 6:
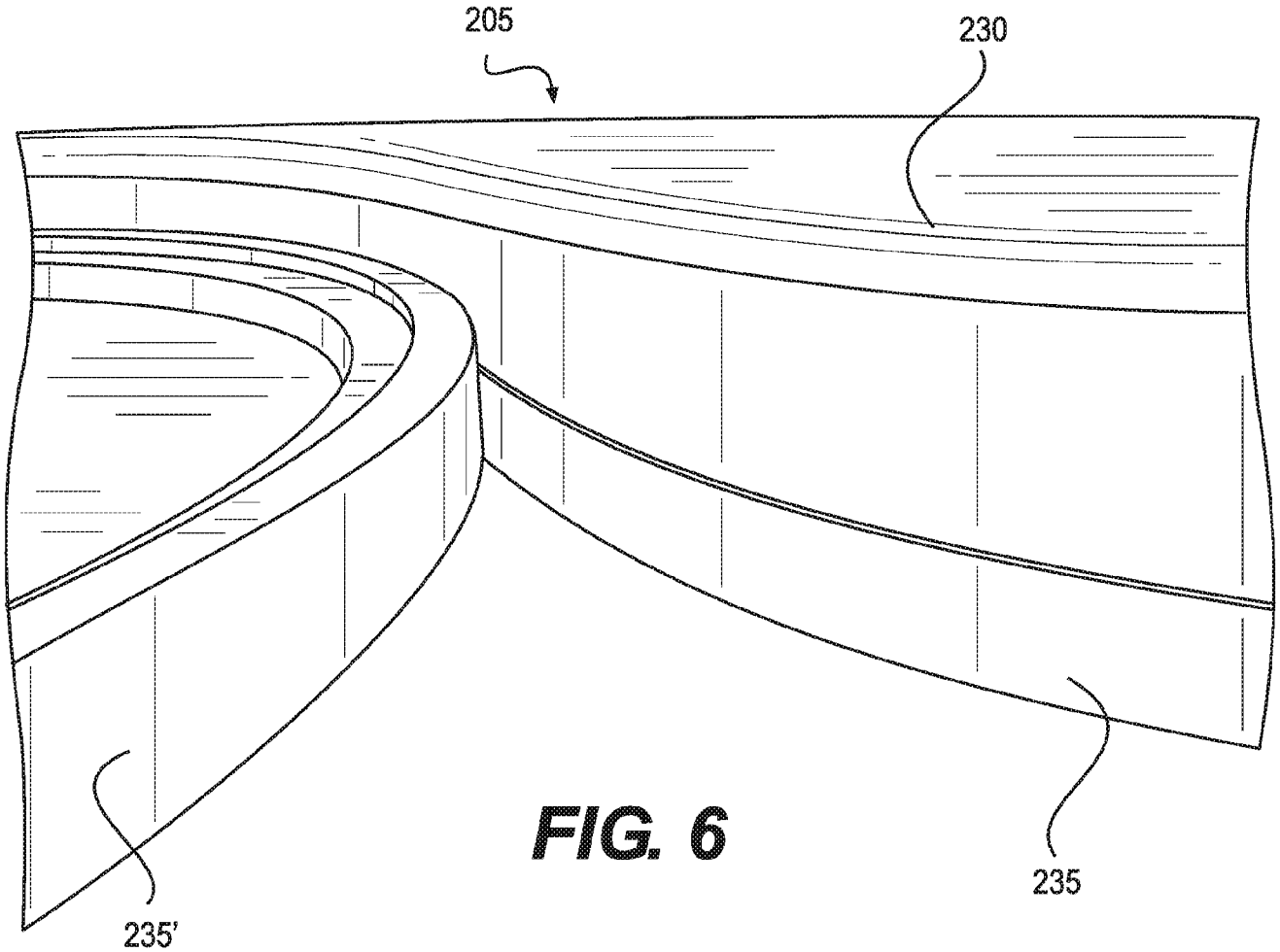
FIG. 6 illustrates a guitar body comprising a top body and one of a plurality of "swappable" or interchangeable back bodies in accordance with aspects of the disclosure.

FIG. 6 illustrates a guitar body 205 comprising a top body 230 and one of a plurality of "swappable" or interchangeable back bodies 235, 235' in accordance with aspects of the disclosure. As shown in FIG. 6, the back body 235 is attached to the top body 230, and a further back body 235' (having a larger thickness) is shown side-by-side with back body 235 (e.g., for comparison). In accordance with additional aspects of the disclosure, the guitar body 205 may comprise the top body 230 and one of a plurality of "swappable" or interchangeable back bodies 235, 235'. For example, a guitarist may have a ½" thick back body, ¾" thick back body, and 1" thick back body (and/or back bodies made of different materials) all structured for attachment to the same top body 230. In accordance with aspects of the disclosure, by utilizing a swappable back body, players can "dial-in" their desired tone by using different back thicknesses and/or different wood species options. Furthermore, if a user desires to alter their tone (e.g., for different song compositions, or in different venues) they can utilize a different back body. Additionally, as discussed in greater detail below, in accordance with aspects of the disclosure, the guitar may be operated without any back body attached thereto, for example, to allow real-time manipulation of electronics or hardware while playing the guitar.

For example, if a player wants to narrow the guitar body profile, they may keep the exact same top body 230 and use, for example, a 0.50" thick back body in place of the "standard" 0.75" thick back body. Or conversely, a player could select a deeper back body (1.25" thick back body) and pair it with (e.g., fasten it to) the guitar. In accordance with aspects of the present disclosure, the "swappable" or interchangeable back body guitar design allows the use of various size (and/or material) backs to change the tone and/or appearance of the guitar. Additionally, implementing these aspects of the disclosure, allows a player to utilize, for example, one or more different species of wood for the back body (e.g., as compared to the material of the top body).

Groove/Shelf Corresponding Engagement

Figure 7:
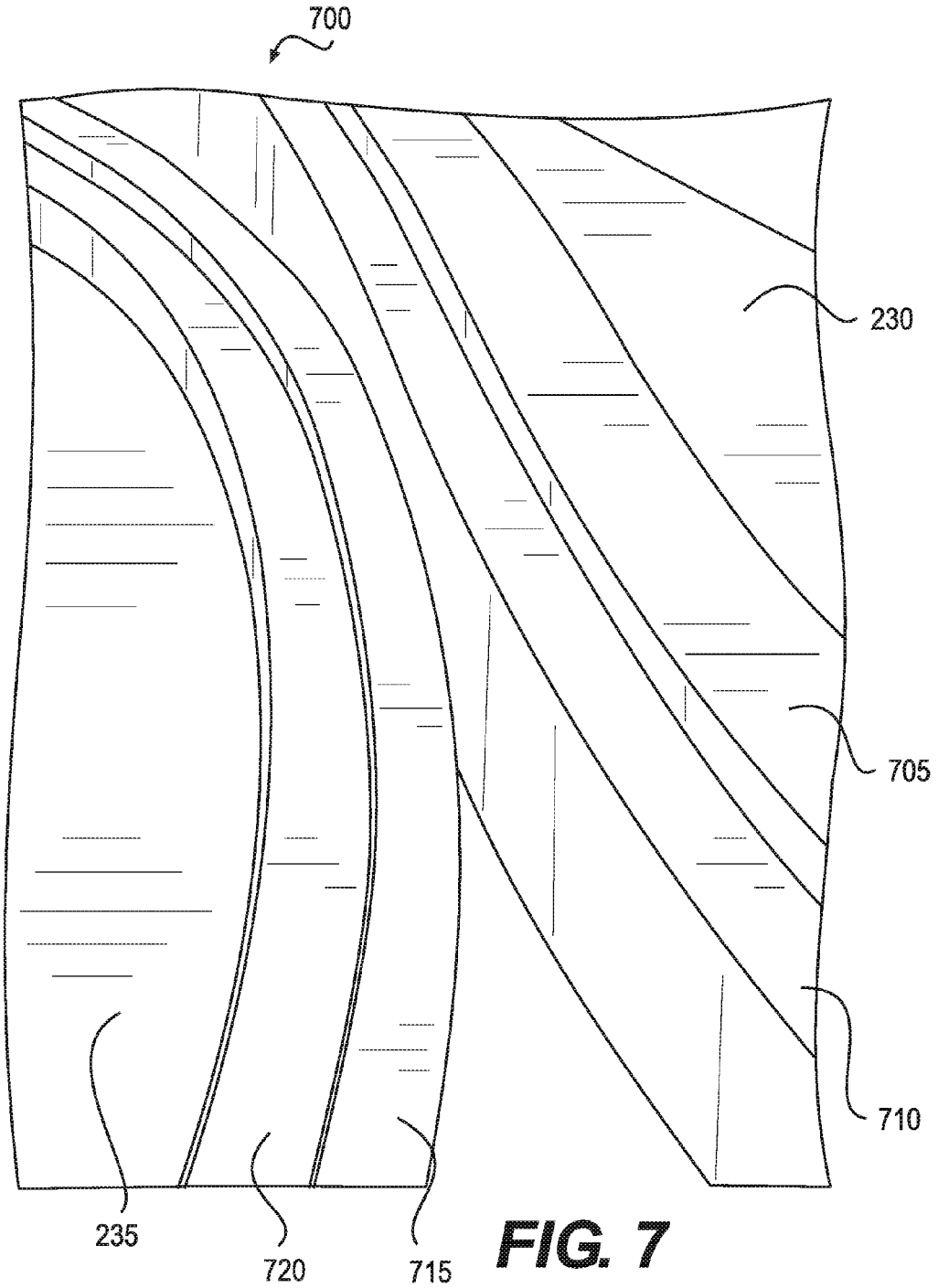
FIG. 7 shows a groove/shelf engagement structure in accordance with aspects of the disclosure.

FIG. 7 shows a groove/shelf engagement structure 700 in accordance with aspects of the disclosure. As shown in FIG. 7, with this exemplary embodiment, the top body 230 includes a raised inner groove (or projection) 705 and a recessed outer shelf 710 arranged along the perimeter of the top body 230. In a complementary fashion, with this exemplary embodiment, the back body 235 includes a raised outer groove (or projection) 715 and a recessed inner shelf 720 arranged along the perimeter of the back body 235. In accordance with aspects of the disclosure, when the top body 230 and the back body 235 are placed together so as to form the guitar body, the raised outer groove 715 of the back body 235 contacts the recessed outer shelf 710 arranged along the perimeter of the top body 230, and the raised inner groove (or projection) 705 of the top body 230 contacts the recessed inner shelf 720 arranged along the perimeter of the back body 235. In such a manner, in accordance with aspects of the disclosure, groove/shelf engagement structure 700 enables the two parts to join easily and securely, with proper positioning and centering.

As should be understood, the height of the raised inner groove (or projection) 705 above the recessed outer shelf 710 should be approximately equal to the height of the raised outer groove (or projection) 715 above the recessed inner shelf 720, so that when the top body 230 is attached to the back body 235, both the raised inner groove (or projection) 705 contacts the recessed inner shelf 720, and the raised outer groove (or projection) 715 contacts the recessed outer shelf 710.

While the exemplary embodiment depicts the top body 230 including a raised inner groove (or projection) 705 and a recessed outer shelf 710 arranged along the perimeter of the top body 230, and the back body 235 including a raised outer groove (or projection) 715 and an recessed inner shelf 720 arranged along the perimeter of the back body 235, the inventor contemplates a reversed arrangement. That is, with certain embodiments, the top body may include a raised outer groove (or projection) and a recessed inner shelf arranged along the perimeter of the top body, and the back body 235 may include a raised inner groove (or projection) and a recessed outer shelf arranged along the perimeter of the back body 235.

Additionally, by utilizing the groove/shelf engagement structure 700, in which, for example, portions of the top body thickness project into the back body, the total resulting thickness of the assembled guitar body is less than the sum of the thicknesses of the top body and the back body. That is, by utilizing the groove/shelf engagement structure 700, with an exemplary embodiment, the overall thickness of the guitar body may be reduced down from 2.0" to approximately 1.82." Making the guitar body closer in feel to the "standard" 1.75" thickness that was adopted in the 1950s, while also providing enough mass in the top body 230 to produce an ideal amount of sustain.

Figure 8:
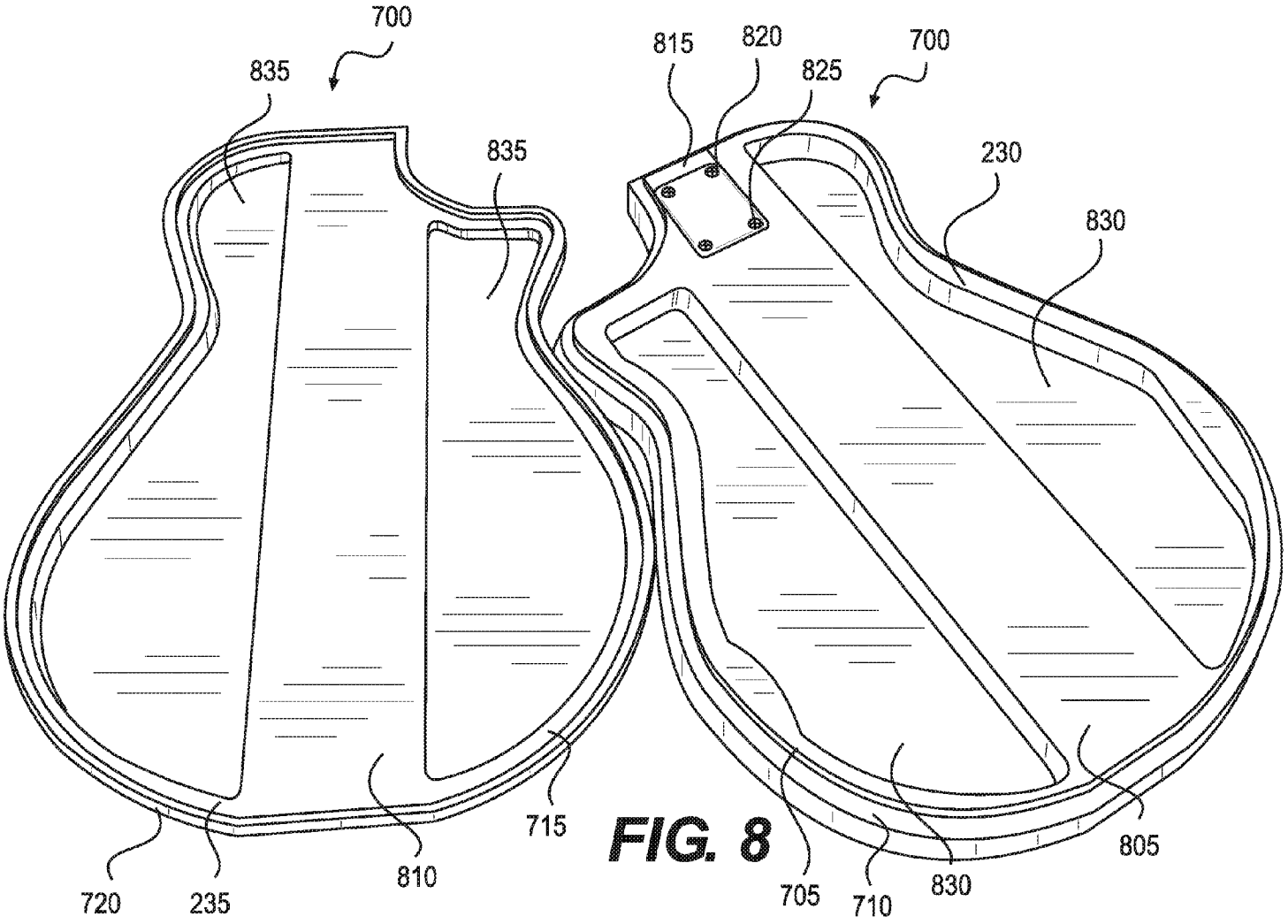
FIG. 8 shows a view of the inside of the top body and the inside of the back body illustrating the complementary groove/shelf engagement structure in accordance with aspects of the disclosure.

FIG. 8 shows a view of the inside of the top body 230 and the inside of the back body 235 illustrating the complementary groove/shelf engagement structure 700 in accordance with aspects of the disclosure.

Figure 9A:
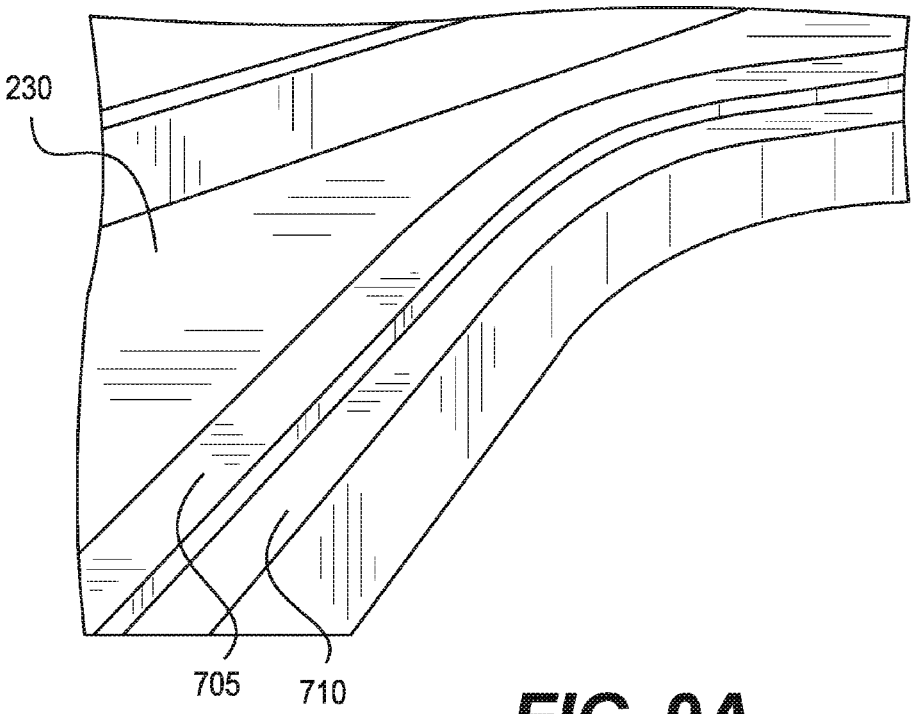
FIGS. 9A and 9B show views of the inside of the top body in accordance with aspects of the disclosure.
Figure 9B:
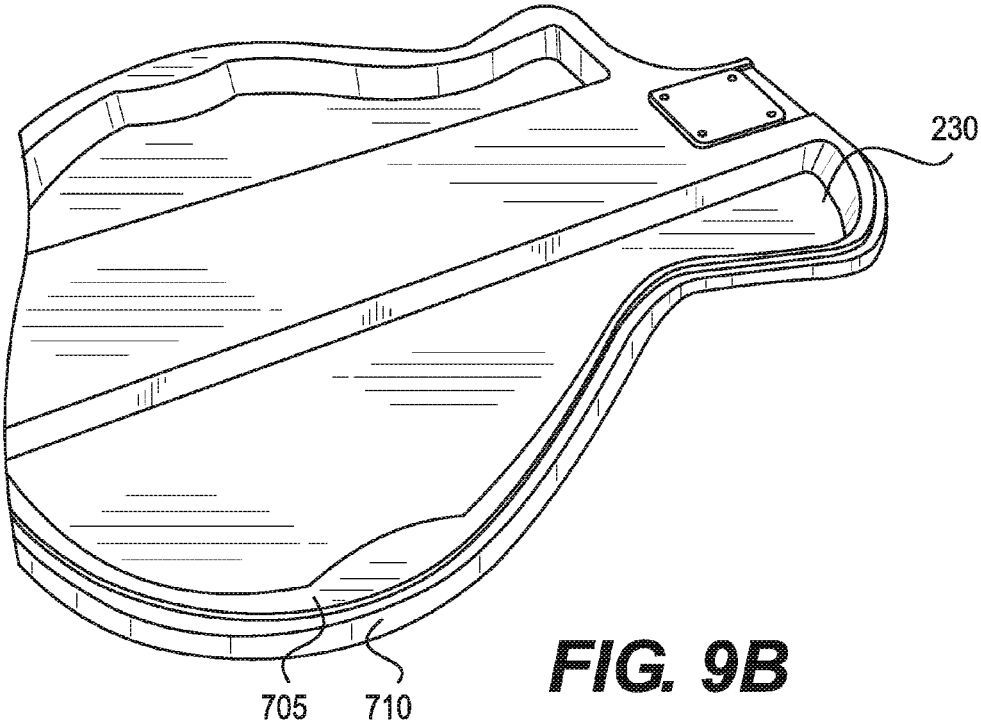

FIGS. 9A and 9B show views of the inside of the top body 230 in accordance with aspects of the disclosure. As shown in FIGS. 9A and 9B, with an exemplary and non-limiting embodiment, a raised groove 705 with a width measuring approximately 0.35" traverses the entire perimeter of the top body 230. The shelf 710 is located below and outwardly (relative to the groove 705) next to the raised groove 705, and also runs the entire perimeter of the top body 230 and is also approximately 0.35" wide—for a total body wall thickness of the top body 230 of approximately 0.70" (at least along the thickness direction of the top body 230). The top of the raised groove 705 is approximately 0.18" above the shelf 710. While the exemplary embodiment includes a total body wall thickness of the top body 230 of approximately 0.70", the inventor contemplates other wall thicknesses of the top body, for example, ranging from 0.5" to 0.075". Furthermore, in embodiments having smaller internal cavities, the effective wall thickness may be even larger.

Figure 10A:
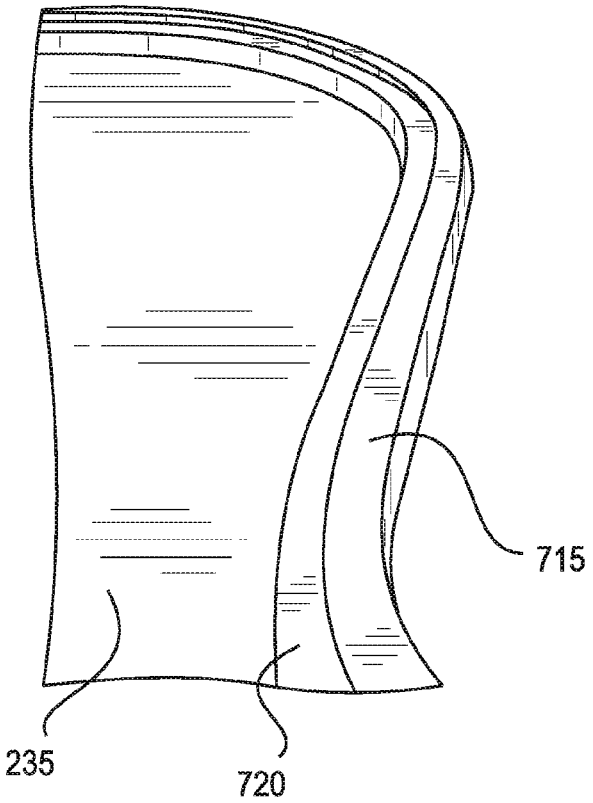
FIGS. 10A and 10B show views of the inside of the back body in accordance with aspects of the disclosure.
Figure 10B:
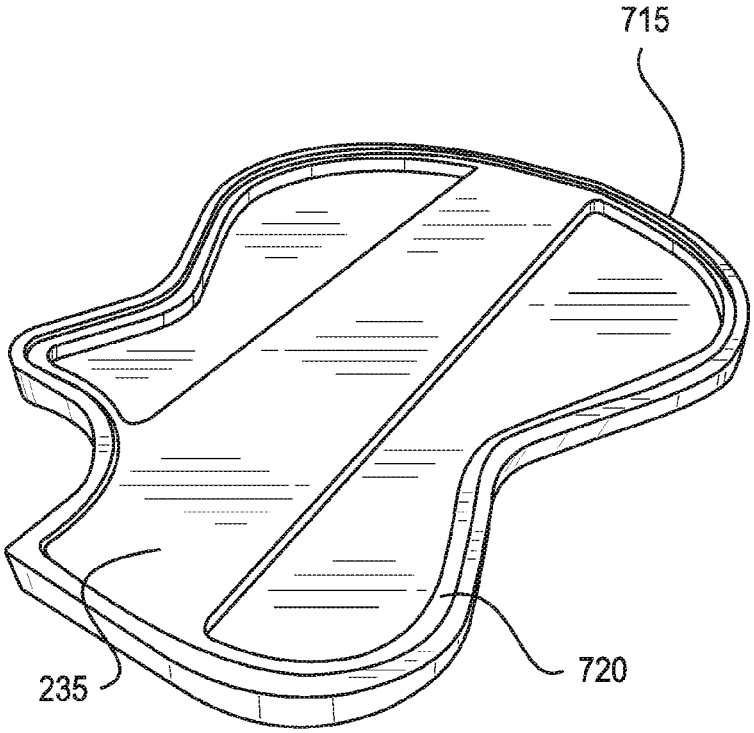

FIGS. 10A and 10B show views of the inside of the back body 235 in accordance with aspects of the disclosure. As shown in FIGS. 10A and 10B, on the back body 235, the locations of the raised groove 715 and recessed shelf 720 are reversed (when compared to the top body 230). The raised groove 715 is located on the outside edge of the back body 235 and is approximately 0.325" wide, and the recessed shelf 720 is also approximately 0.325" wide, for a total wall width of the back body of approximately 0.65" (at least along the thickness direction of the back body 235). While the exemplary embodiment includes a total body wall thickness of the back body 235 of approximately 0.65", the inventor contemplates other wall thicknesses of the back body, for example, ranging from 0.5" to 0.075". Furthermore, in embodiments having smaller internal cavities, the effective wall thickness may be even larger.

As also shown in FIG. 8, in accordance with additional aspects of the disclosure, a "tone block" 805 extends the entire length of the top body 320, and with this exemplary and non-limiting embodiment, has a width of approximately 3.8". Additionally, as shown in FIG. 8, the tone block 805 projects to the same height (in a thickness direction) as that of the raised groove 705 along at least most of the length of the tone block 805. (As discussed below, the tone block 805 may have a recessed region structured and arranged to accommodate a neck plate and fasteners.) In accordance with aspects of the disclosure, when the top body 230 and the back body 235 are joined together, the tone block 805 of the top body 230 rests on top of (i.e., is in contact with) a corresponding tone block 810 of the back body 235. In other words, the tone block 810 of the back body 235 aligns with the tone block 805 arranged on the underside of the top body 230.

FIG. 8 also shows the tone block 805 includes a recessed region 815 structured and arranged to accommodate a neck plate 820 and the tops of fasteners 825. The neck plate 820 is used to support the connection of the top body 230 to a "bolt-on" neck (not shown). That is, a plurality of fasteners 825 (e.g., screws or bolts) pass through the neck plate 820 and through the tone block 805 of the top body 230 to connect with the neck, so as to securely attach the neck to the top body 230. The recessed region 815 has a depth to accommodate the thickness of the neck plate 820 and the tops of fasteners 825 (e.g., if they project beyond the neck plate 820), such that neither the neck plate 820 nor the tops of fasteners 825 project beyond the height of the tone block 805. As such, when the top body 230 is joined to the back body 235, neither the neck plate 820 nor the tops of fasteners 825 interfere with (e.g., prevent) the contact of the tone block 805 of the top body 230 with the corresponding tone block 810 of the back body 235. Moreover, as discussed in greater detail below, in accordance with aspects of the disclosure, when the top body 230 is joined to the back body 235, the back body 235 covers the neck plate 820, such that the neck plate 820 is internal to the guitar body 200 and hidden from view.

As shown in FIG. 8, in embodiments, the top body 230 may include hollowed regions 830, and the back body 235 may include hollowed regions 835. In accordance with additional aspects of the disclosure, by forming the top body 230 to include hollowed regions (or cavities) 830 and/or by forming the back body 235 to include hollowed regions, the overall weight of the guitar may be reduced, increasing the playability of the instrument, while affecting the resonance characteristic of the instrument. Additionally, the hollowed regions 830 of the top body 230 may accommodate electronics for the instrument. In accordance with aspects of the disclosure, because, in embodiments, the hollowed regions 830 of the top body 230 are formed over a significant portion of the top body 230, a user is less constrained in where they chose to arrange electronics and associated actuators. In other words, in accordance with aspects of the disclosure, the hollowed regions 830 of the top body 230 allow the guitar to be more customizable.

Internal Hidden Neck Plate

Figure 11:
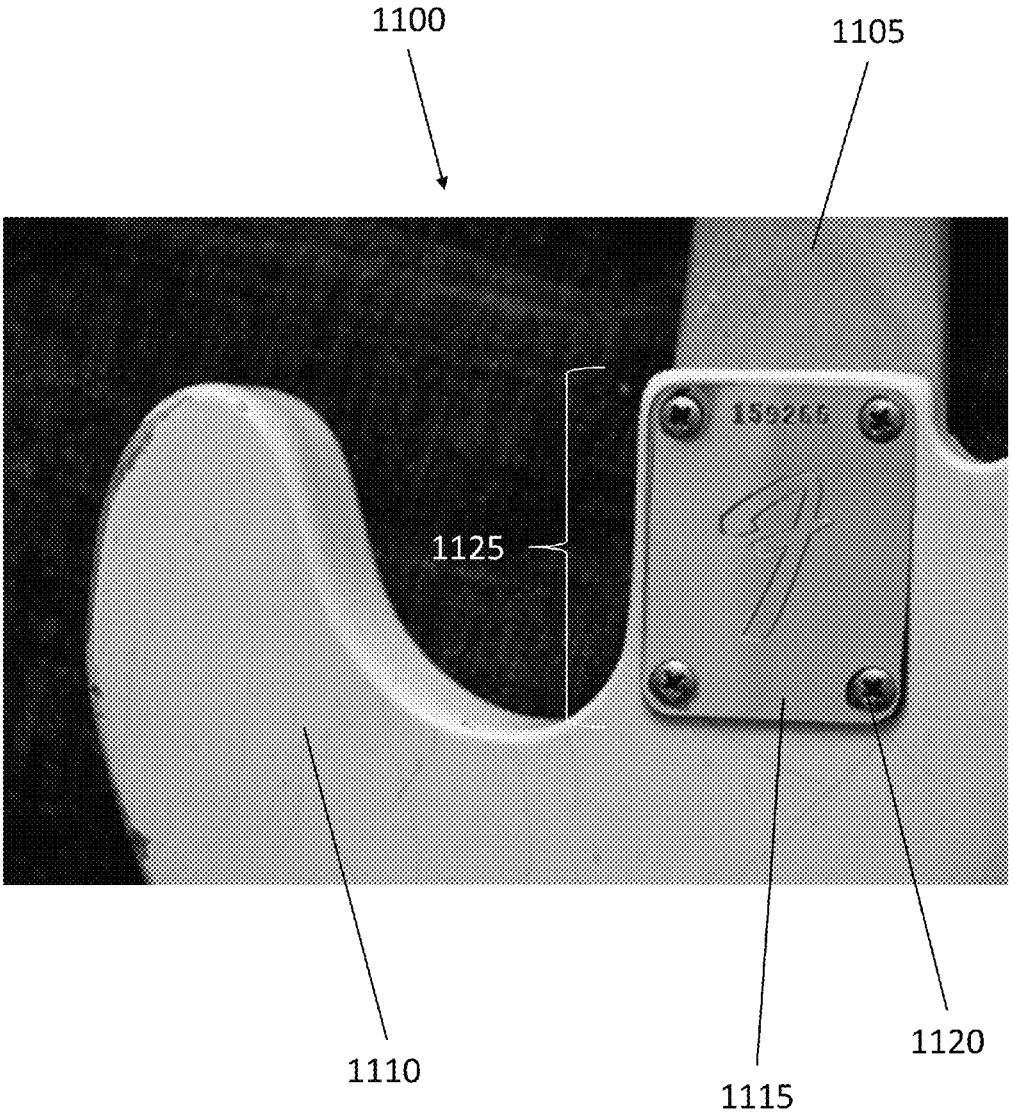
FIG. 11 (Prior Art)
FIG. 11 shows a conventional bolt-on neck arrangement.

FIG. 11 shows a conventional bolt-on neck arrangement 1100. As shown in FIG. 11, a neck 1105 is fastened to a guitar body 1110 using a neck plate 1115 arranged on the opposite side of the guitar body 1110 as the neck 1105 (i.e., the back side of the guitar). A plurality of fasteners 1120 (e.g., screws, or bolts) pass through the neck plate 1115 and through the guitar body 1110 to connect with the neck 1105, so as to securely attach the neck 1105 to the guitar body 1110. As can be observed in FIG. 11, with a conventional bolt-on neck arrangement 1100, the neck plate 1115 and plurality of fasteners 1120 are viewable from the back side of the guitar body 1110. As also shown in FIG. 11, with a conventional bolt-on neck arrangement 1100, the neck plate 1115 is structured and arranged in a manner that prevents any sculpting or carving at the sides of the guitar body in regions around the neck plate (e.g., region 1125).

Figure 12B:
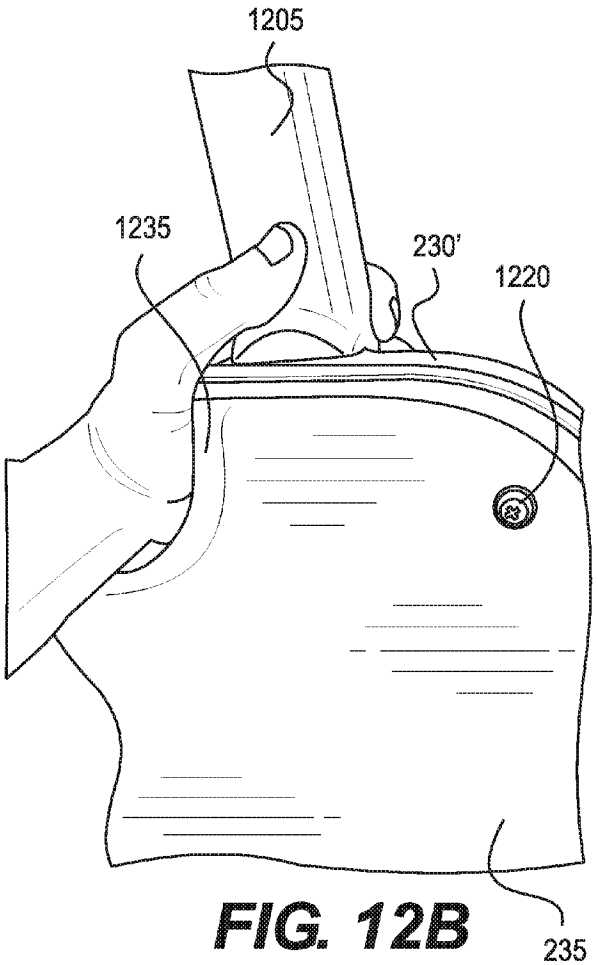
FIGS. 12A and 12B illustrate views of the internal hidden neck plate bolt-on neck construction of the present disclosure.
Figure 12A:
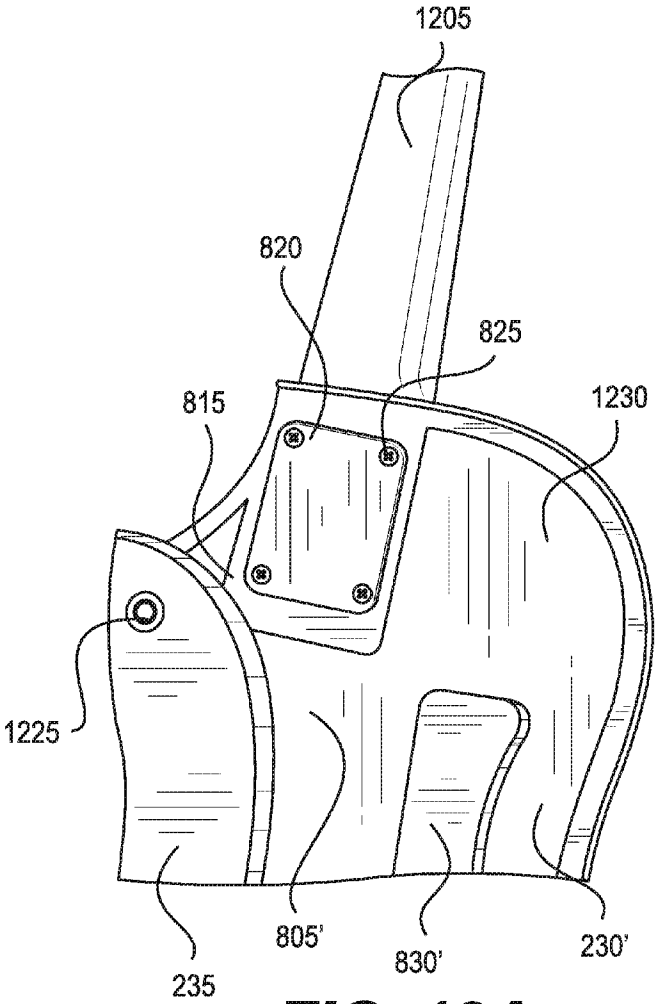

FIGS. 12A and 12B illustrate views of the internal hidden neck plate bolt-on neck construction of the present disclosure. As shown in FIG. 12A, in accordance with aspects of the present disclosure, the top body 230' is connected to a neck 1205 using a bolt-on neck method, in which the guitar neck 1205 is joined to the top body 230' using fasteners 825 (e.g., screws or bolts) and a neck plate 820, as opposed to glue as with set-in neck joints. The back body 230' may include a recessed region 815 structured and arranged to accommodate the neck plate 820. The recessed region 815 has a depth to accommodate the thickness of the neck plate 820 and the tops of fasteners 825 (e.g., if they project beyond the neck plate 820), such that neither the neck plate 820 nor the tops of fasteners 825 project beyond the height of the tone block 805. As such, when the top body 230' is joined to the back body 235, neither the neck plate 820 nor the tops of fasteners 825 interfere with (e.g., prevent) the contact of the tone block 805' of the top body 230' with the corresponding tone block of the back body 235.

As shown in FIG. 12B, in accordance with further aspects of the disclosure, when the top body 230' is joined to the back body 235, the back body 235 covers the neck plate 820, such that the neck plate 820 is internal to the guitar body 200 and hidden from view. In such a manner, the guitar, which has a bolt-on neck construction, has the appearance and/or feel of a set-in neck guitar construction (i.e., a guitar having a set-in neck). Set-in neck is a method of guitar (or similar stringed instrument) construction that involves joining neck and body with a tightly fitted mortise-and-tenon or dovetail joint, secured with some sort of adhesive.

By implementing this aspect of the disclosure, the neck joint area 1235 (e.g., the backside region of the guitar where the neck meets the guitar body) may be sculpted for more comfort and increased upper neck access. More specifically, the region on the back body opposite the internal neck plate is not obstructed by the neck plate, and can thus be sculpted. This is typically not possible for a guitar with a bolt-on neck, in which the neck plate precludes any increased sculpting of the neck joint area on the back side of the guitar.

For example, by connecting the neck 1205 to the back side (or inside) of the top body 230', and covering the neck plate 820 with the back body 235 when assembled, this allows the back of the guitar to be carved or sculpted 1235 for increased comfort and greater upper-fret neck access. That is, with such a construction, there is a region of the back side of the guitar not covered by a neck plate, from which material of the back body can be removed to provide a more sculpted neck joint area, which increases the playability and comfort of the instrument. Additionally, by implementing this aspect of the disclosure, the guitar achieves a clean, streamlined look to the back of the guitar. In an exemplary and non-limiting embodiment, the back body 235 of the guitar is secured to the top body 230' using screws 1220 (e.g., five screws) arranged, for example, along the perimeter region of the back body 235. As shown in FIG. 12A, the top body 230' may include corresponding (e.g., pre-drilled) holes 1230 structured and arranged for receiving respective screw 1220.

As shown in FIG. 12A, in accordance with aspects of the disclosure, guitar body 230' has a hollowed region (or cavity) 830' that is smaller than the hollowed region (or cavity) 830 of guitar body 230 (see FIG. 8). In embodiments, the size (e.g. length, width, and/or depth) of the hollowed regions (or cavities) 830/830' may be varied to provide different resonant frequency to the guitar body and/or to alter the tone and/or weight of the guitar body.

Neck Pocket

Figure 13A:
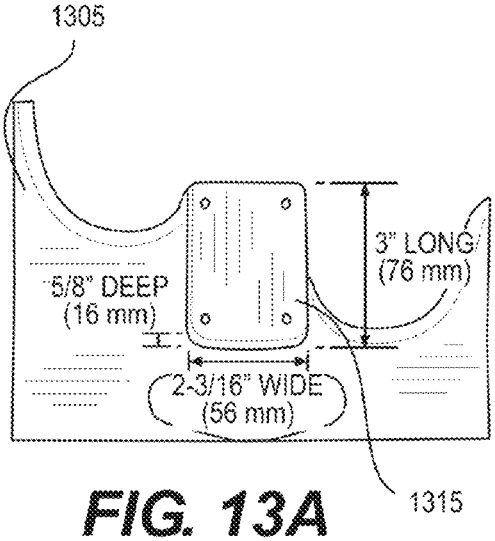
FIG. 13A (PRIOR ART)
FIGS. 13A-13C illustrate a top view of conventional Stratocastor® (or Strat®) neck pocket, a top view of a conventional Telecaster® (or Tele®) neck pocket, and a side section view of a tele/strat neck pocket, respectively.
Figure 13B:
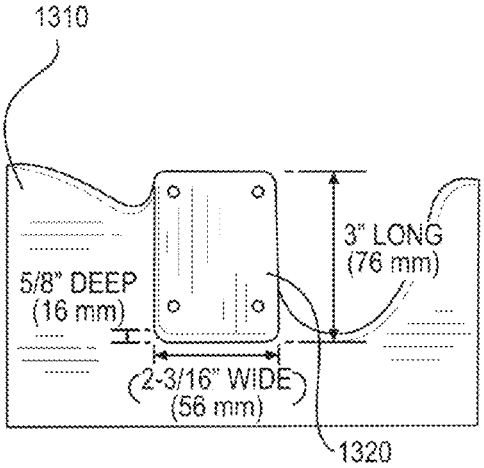
FIG. 13B (PRIOR ART)
Figure 13C:
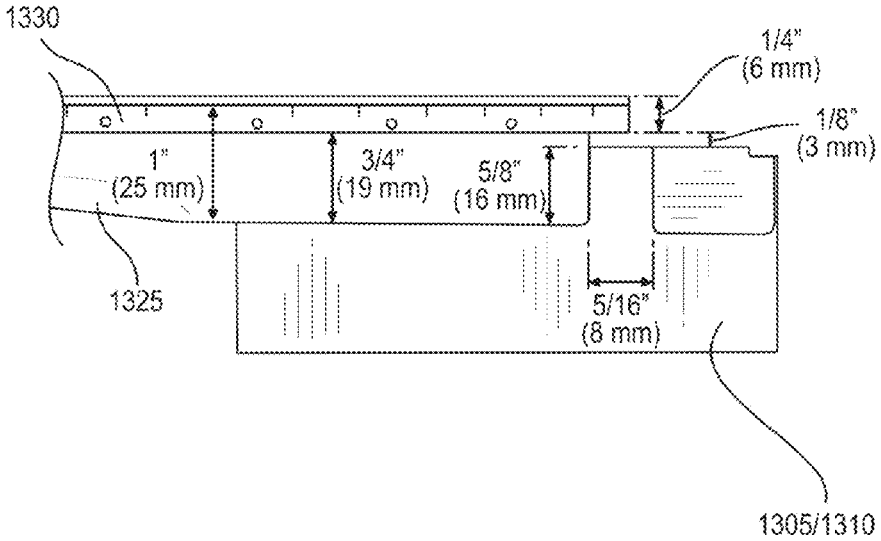
FIG. 13C (PRIOR ART)

FIGS. 13A-13C illustrate a top view Stratocastor® (or Strat®) neck pocket, a top view of a Telecaster® (or Tele®) neck pocket, and a side section view of a tele/strat neck pocket, respectively. As shown in FIGS. 13A-13C, a traditional guitar body (e.g., Stratocastor 1305 or Telecaster 1310) that utilizes a bolt on neck, has a neck pocket 1315, 1320 that is 2 3/16" wide, 3 inches long and 5/8" (15.875 mm, or approximately 16 mm) deep. As shown in FIG. 13C, when a neck 1325 is attached to a traditional bolt-on neck electric guitar body (e.g., Stratocastor 1305 or Telecaster 1310), the top of the neck's fretboard 1330 sits approximately 9 mm (e.g., 6 mm+3 mm) off the body 1305/1310.

Figure 14:
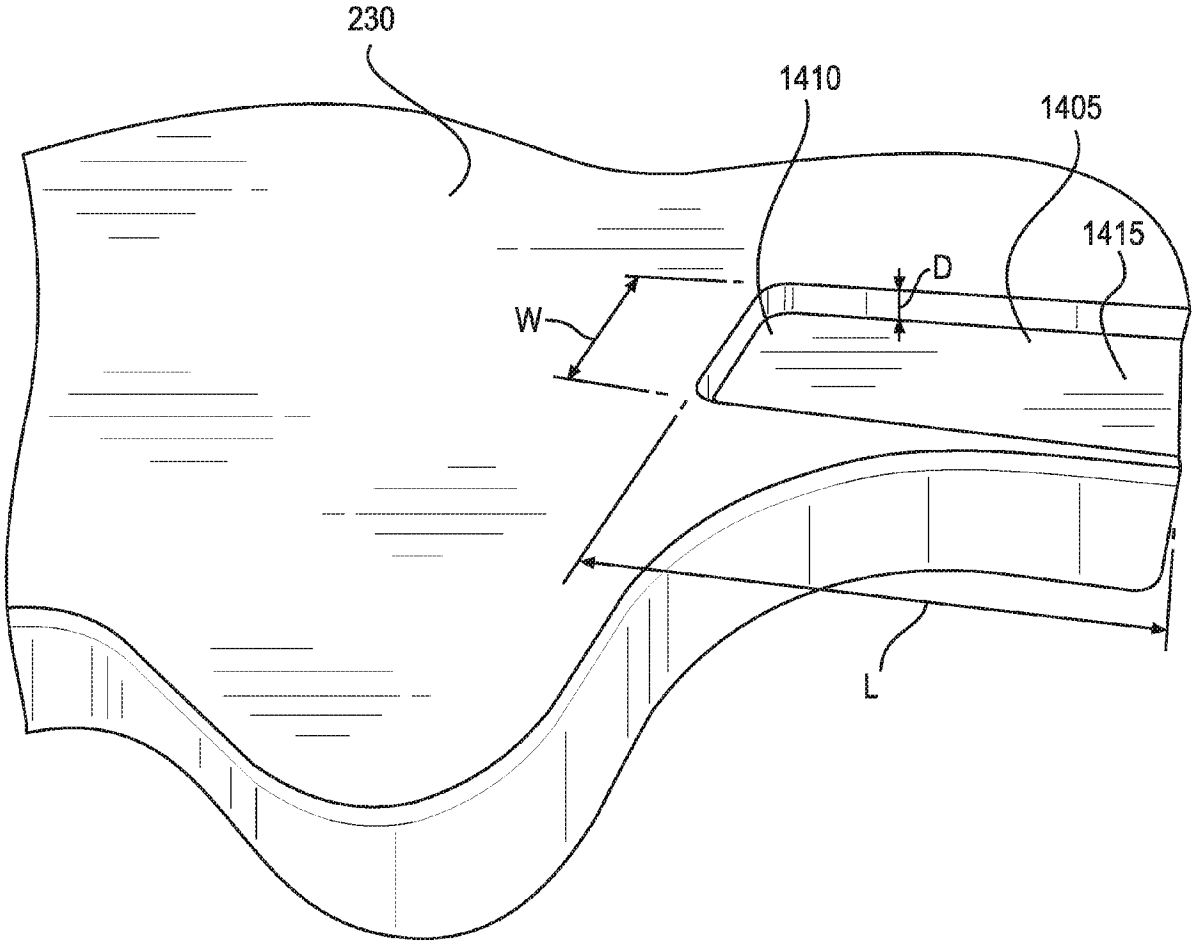
FIG. 14 illustrates a view of a neck pocket in accordance with aspects of the disclosure.

FIG. 14 illustrates a view of a neck pocket 1405 arranged on the top body 230 in accordance with aspects of the disclosure. As shown in FIG. 14, the depth D of the neck pocket 1405 is shallower than traditional neck pocket (see, e.g., FIGS. 13A-13C). For example, with a non-limiting exemplary embodiment, the depth D of the neck pocket 1405 is approximately 8 mm. In comparison, as shown in FIGS. 13A-13C, the depth of a traditional neck pocket is 16 mm.

Additionally, in embodiments, the neck pocket may be angled (for example, approximately 2°), such that when a neck is arranged therein the neck is angled with respect to the guitar body. In such embodiments, the depth D may vary across the length of the pocket. With an exemplary and non-limiting example, the depth at a bridge-end of the pocket 1410 may be shallower, e.g., approximately 6.4 mm, and the depth at the opposite end of the pocket 1415 may be deeper, e.g., approximately 8.5 mm. Accordingly, when a neck is arranged in the pocket, the neck will sit more shallowly at the bridge-end of the pocket 1410 and will sit more deeply the opposite end of the pocket 1415, and thus, be angled with respect to the guitar body.

Figure 15:
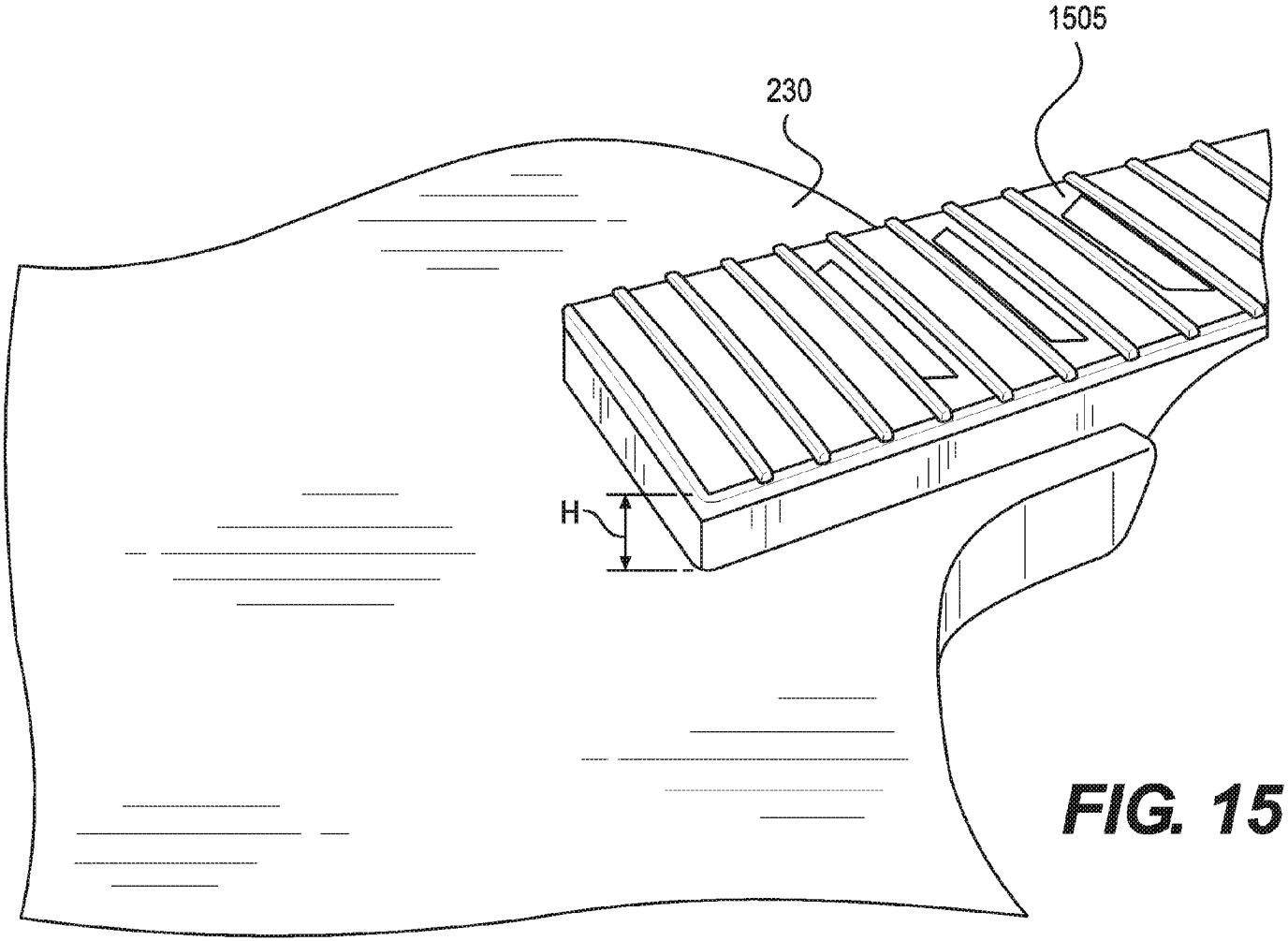
FIG. 15 illustrates a view of a neck pocket with a neck positioned therein in accordance with aspects of the disclosure.

FIG. 15 illustrates a view of a guitar top body 230 with a neck 1505 positioned in a neck pocket accordance with aspects of the disclosure. As shown in FIG. 15, in accordance with aspects of the disclosure, by utilizing a shallower neck pocket (that is, a neck pocket having a smaller depth D), when the neck 1505 is arranged in the neck pocket 1405, the height H of the guitar neck (or the fret board on the guitar neck) above the top body 230 may be increased (as compared to conventional neck arrangements), thus increasing the string clearance for arrangement of pickups (not shown) on the top body 230.

By implementing these aspects of the disclose, the guitar allows for multiple varieties of pickups to be, for example, surface-mounted anywhere on the top surface of the guitar top body 230 between the neck heel (i.e., the end of the neck 1505 in the region of the neck pocket 1405) and bridge (not shown). As noted above, in some embodiments, the top body 230 may include one or more pickup cavities, sized to accommodate one or more pickups. In accordance with aspects of the disclosure, the top body 230 may be thick enough to enable traditional routing for the pickups as a possibility for the custom guitar builder.

Some pickups, such as humbuckers, for example, may require modification for surface mounting to the top body 230. The modification may include, for example, using different pickup rings to convert humbuckers to a surface-mount configuration. The pickup rings are configured to accept as many modern humbucker style models as possible. As compared with conventional pickup rings, with the present disclosure, due to the surface mounting of the pickups, the pickup rings are substantially thicker (e.g., two to three times as thick as a conventional pickup ring). Once the desired height of the strings is determined (e.g., based on the height of the neck (and fret board) and the height of the bridge), a gap of about 3/32" should be utilized between the underside of the strings and the top of the pickups used. For instance, after the guitar is tuned and the strings are at the desired height, subtract 3/32" from the string height above the guitar body—this will be the desired height for the top surface of the pickups. This may be done for both the neck and bridge pickup, for example, if the guitar is to have two pickups. While the guitar body is structured to accommodate as many different parts as possible, the neck, bridge, and pickups utilized may ultimately be used to determine how high the various parts sit off the guitar surface and how the pickups are ultimately secured to the body.

With reference to FIG. 14, with an exemplary embodiment, the neck pocket 1405 has a width W of 2 3/16" (e.g., similar to conventional widths), but has a length L of approximately 3.2"-3.5" and a depth D of approximately 0.32" (8 mm). With the shallow guitar neck pocket, the neck (and the top of the fret board) is raised higher off the guitar top body 230 (e.g., approximately 18 mm above the guitar top body 230 versus the traditional 9 mm found on a Fender style guitar (see FIG. 13C)) allowing the electronics/pickups 215 to be surface mounted and not require routing for their mounting to the guitar top body 230 (see, e.g., FIG. 2). Additionally, the neck pocket 1405 has a length L that is approximately 0.5" longer than a conventional neck pocket. In accordance with aspects of the disclosure, the increased pocket length provides increased surface contact between the bottom of the neck (not shown) and the top body 230.

The present disclosure also provides for improving the sound from the guitar by creating a more solidly mounted system for coupling the strings to a resonating guitar body. In accordance with aspects of the disclosure, the solid connection and increased surface contact area provided by the longer neck pocket 1405 allows for the guitar instrument to resonate better, thus transferring the sound to the instrument body and enhancing the played notes.

Wood/Foam Inserts

Figure 16A:
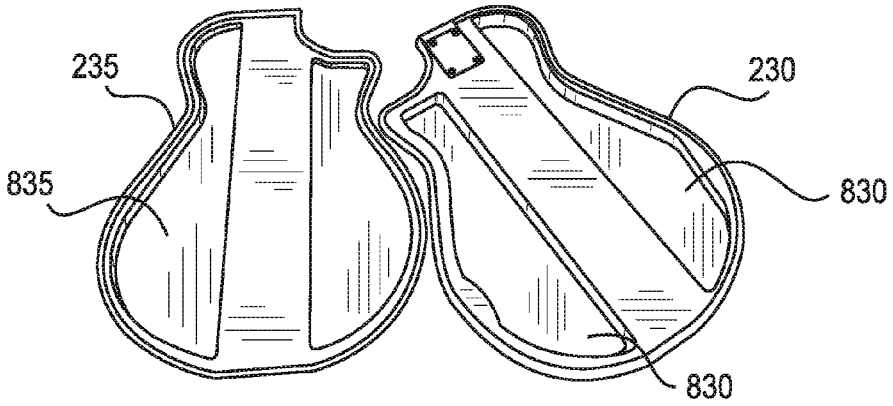
FIGS. 16A-C schematically depict optional removable inserts that may be arranged in one or more hollowed portions or cavities of the top body and/or back body in accordance with further aspects of the disclosure.
Figure 16B:
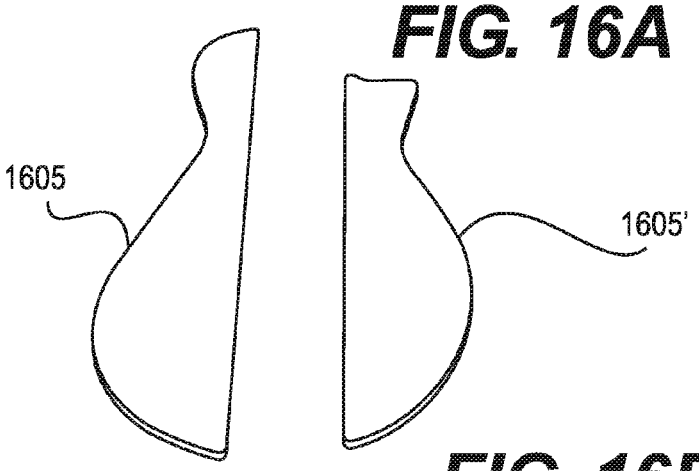
Figure 16C:
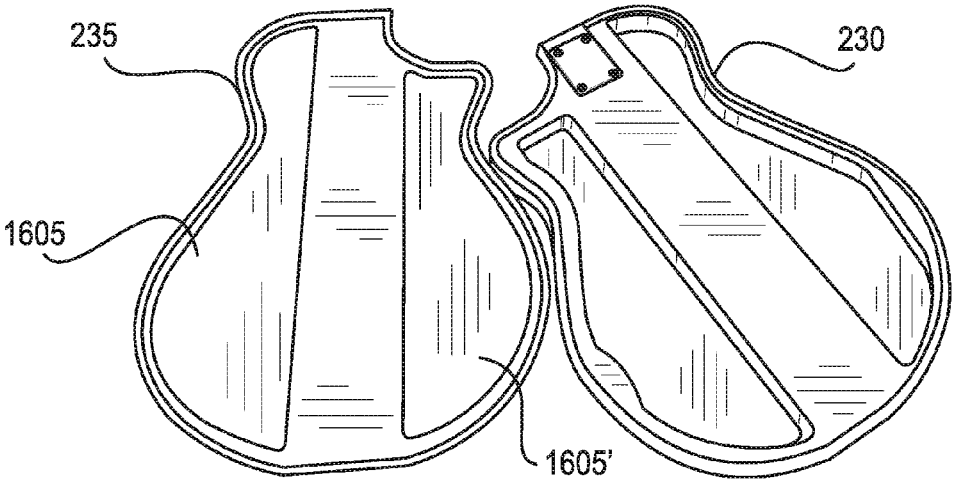

FIGS. 16A-C schematically depict optional removable inserts 1605, 1605' that may be arranged in one or more hollowed portions or cavities 830, 835 of the top body 230 and/or back body 235 in accordance with further aspects of the disclosure. As shown in FIG. 16A (and discussed above), the top body 230 may include one or more hollowed portions or cavities 830 and the back body 235 may include one or more hollowed portions or cavities 835. As shown in FIG. 16B, in accordance with further aspects of the disclosure, one or more optional removable inserts 1605, 1605' (e.g., wood or foam inserts) structured and arranged for insertion in the hollowed regions or cavities 830, 835 (e.g., routed areas) of the guitar. For example, as shown in FIG. 16C, optional removable inserts 1605, 1605' are arranged in the hollowed regions or cavities 835 of the guitar back body 235. In embodiments, the inserts may be sized to fill (or occupy) a portion of the hollowed regions or cavities 830 of the guitar top body 230 and/or the hollowed regions or cavities 835 of the guitar back body 235. In certain embodiments, an insert 1605 may only occupy a portion of the hollowed regions or cavities 830, 835. For example, the insert 1605 may only occupy a portion of the length and/or width of the hollowed regions or cavities 830, 835. In further embodiments, the insert 1605 may only occupy a portion of the height of the hollowed regions or cavities 830, 835.

In further embodiments, as shown in FIG. 16C, the inserts may be sized to fill (or occupy) an entirety (or an approximate entirety) of one or more hollowed regions or cavities 830, 835. In accordance with aspects of the disclosure, the inserts allows a user to modify the guitar, for example, to switch from a more resonant semi-hollow design/sound to more of a chambered/sustained solid body sound. For example, inserting wood into the hollowed regions or cavities 830, 835 of guitar could change the guitar from having a resonant semi-hollow design/sound to more of a chambered/sustained sound. In embodiments, the inserts may be wood inserts of the same species of wood as the utilized for other elements of the guitar (e.g., guitar top body 230 and/or back body 235), or may be different species of wood.

Bridge Assembly

Figure 17A:
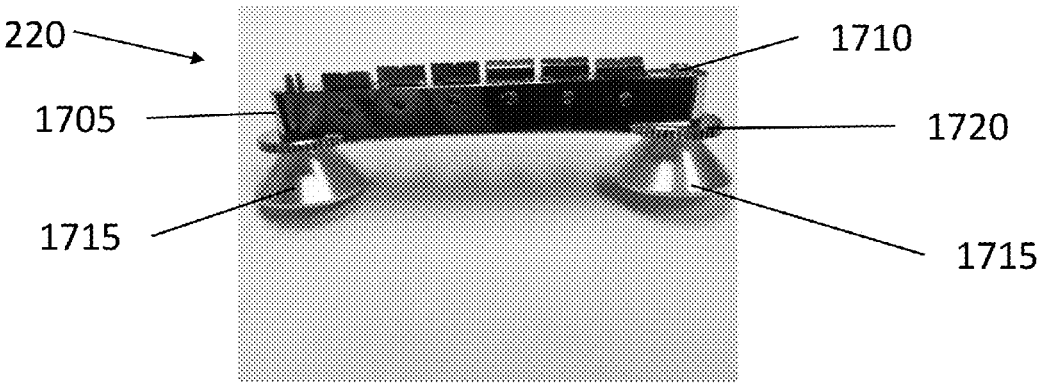
FIGS. 17A-17F show elements of an exemplary bridge assembly having a bridge, mounting posts, and respective bases having a conical profile in accordance with aspects of the disclosure.
Figure 17B:
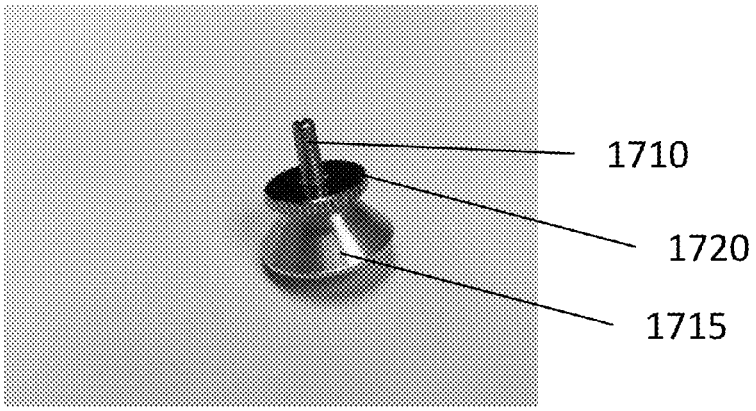
Figure 17C:
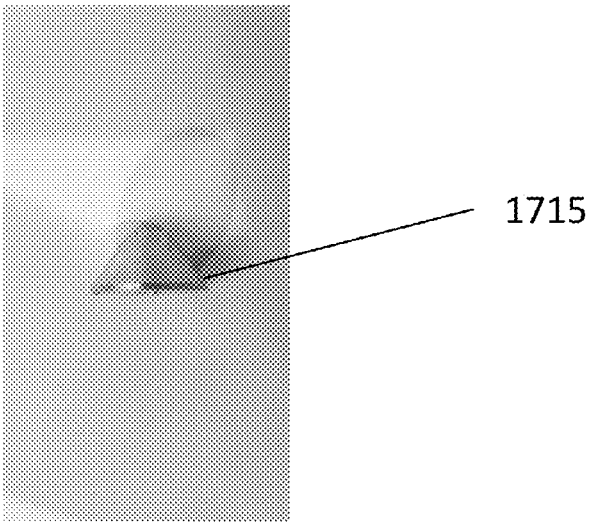
Figure 17D:
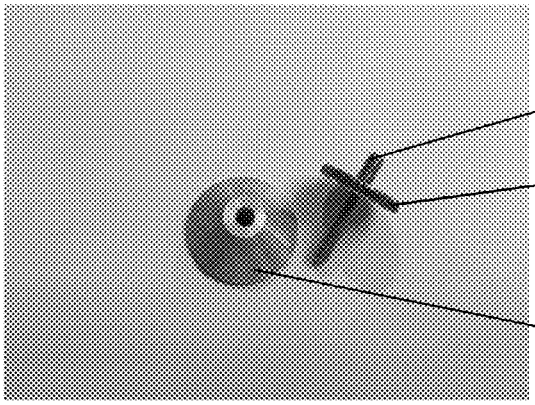
Figure 17E:
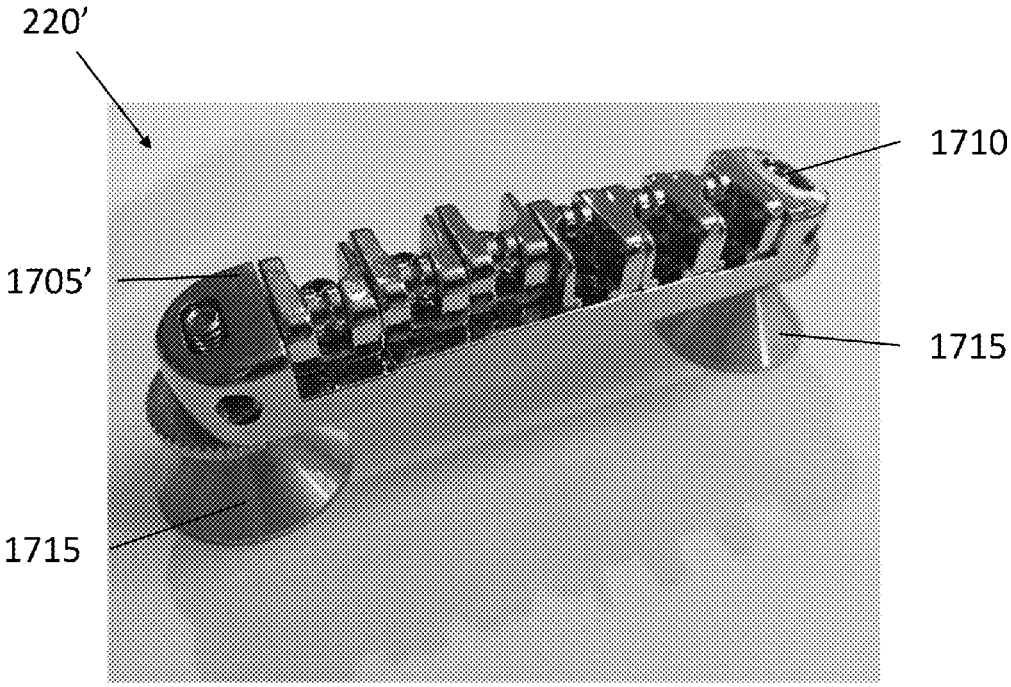
Figure 17F:
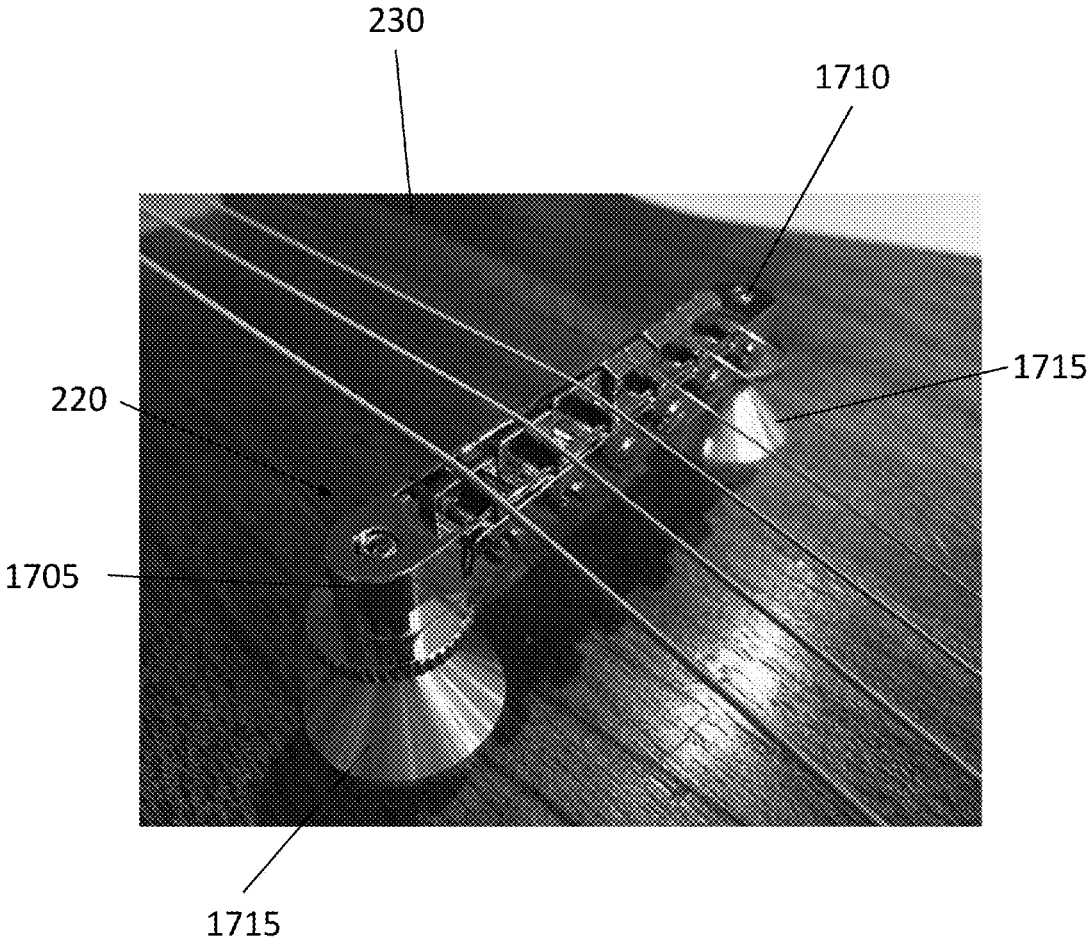

FIGS. 17A-17F show elements of exemplary bridge assembly 220 having a bridge 1705, mounting posts 1710, and a stand 1715 having conical profile in accordance with aspects of the disclosure. As discussed above, the guitar includes a bridge assembly 220 mounted on the top body 230 and over which the strings pass (see, e.g., FIG. 2). As shown in FIGS. 17A-17D, the bridge assembly 220 includes mounting posts 1710 and conically profiled stands 1715. FIG. 17E shows bridge assembly 220' including a stand 1715 and mounting posts 1710 paired with a "roller" style bridge 1705'. FIG. 17F shows the bridge assembly 220 including the bridge 1705, mounting posts 1710 and conically profiled stands 1715 mounted on a guitar top body 230 in accordance with aspects of the disclosure.

In accordance with aspects of the disclosure, the modular guitar body utilizes a bridge assembly 220 (or 220') that allows a higher than typical string clearance over the guitar body (i.e., from the top of the guitar's playing surface to the bridge saddles). This bridge assembly 220 allows strings heights to reach over one inch (1.0") over the guitar body. With an exemplary and non-limiting embodiment, the cone-shaped (or conical) stands 1715 measure between approximately 0.40" and 0.55" tall and are approximately 1.0" wide at the base. The cone-shaped (or conical) stands 1715 have a threaded center to accept guitar bridge posts 1710 and the corresponding height adjustment thumb wheels 1720 that the bridge 1705 utilizes. The bridge 1705 rests on the respective thumb wheels 1720. While embodiments of the disclosure may utilize the bridge assembly 220 (or 220'), it should be understood that the disclosure contemplates many types of bridge assemblies may be utilized, and the disclosure is not limited to the bridge assembly 220. For example, as discussed herein, in accordance with aspects of the disclosure, the guitar body is structured and designed to accept many after-market bridges available today, which can also extend to a string clearance height of over 1.0" (for example, wooden archtop bridges).

Manufacturing

In embodiments, the guitar top body 230 and the back body 235 may be shaped using a CNC machine. In further embodiments, one or more of the guitar top body 230 and the back body 235 may be formed using one or more molds. In yet further embodiments, one or more of the guitar top body 230 and the back body 235 may be formed utilizing 3D printing.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel configuration is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure refers to specific embodiments, those skilled in the art will understand that various changes may be made and equivalents may be substituted for elements thereof without departing from the true spirit and scope of the embodiments of the disclosure. For example, while the disclosure is discussed in the context of guitars, the disclosure could be utilized on other stringed instruments, including, for example, a bass, a mandolin, and/or a banjo. While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. A stringed instrument body, comprising:

a top body having a groove/shelf engagement structure; and a back body having a corresponding shelf/groove engagement structure that is engagable with the groove/shelf engagement structure of the top body;

wherein when the corresponding shelf/groove engagement structure is engaged with the groove/shelf engagement structure, a projecting portion of the groove/shelf engagement structure of the top body projects within the back body and contacts a corresponding recessed portion of the shelf/groove engagement structure of the back body.

2. The stringed instrument body of claim 1, wherein the top body has an approximate thickness of 1.25".

3. The stringed instrument body of claim 1, wherein:

the top body has an approximate thickness of 1.25";

the back body has an approximate thickness of 0.75"; and when the top body is joined to the back body to form the stringed instrument body, the overall thickness of the stringed instrument body is less than 2.0".

4. The stringed instrument body of claim 1, wherein:

the top body has an approximate thickness of A;

the back body has an approximate thickness of B; and when the top body is joined to the back body to form the stringed instrument body, the overall thickness of the stringed instrument body is less than A+B.

5. The stringed instrument body of claim 1, wherein the back body is interchangeable with a different back body having a different thickness and/or different materials so as to modify one or more properties of the stringed instrument body.

6. The stringed instrument body of claim 1, wherein the back body is removably fastenable to the top body.

7. The stringed instrument body of claim 1, further comprising an edging arranged at the junction of the top body and back body along the perimeter of the stringed instrument body.

8. The stringed instrument body of claim 7, wherein the edging covers a seam between the top body and the back body so as to provide an appearance of a single-piece body construction.

9. The stringed instrument body of claim 7, wherein the edging is arranged on the top body and arranged to cover a larger portion of the top body than the back body, such that the top body and the back body appear to have approximately equal thicknesses.

10. The stringed instrument body of claim 1, wherein both the top body and the back body comprise wood.

11. The stringed instrument body of claim 10, wherein the top body and the back body each comprise a different species of wood.

12. The stringed instrument body of claim 1, wherein the top body provides a blank-canvas mounting surface for one or more guitar components.

13. The stringed instrument body of claim 1, wherein the top body includes a tone block extending along the length of the top body on an inner side of the top body, and projects along a length of the tone block to a same height in a thickness direction of the top body as a height of a raised groove of the groove/shelf engagement structure.

14. The stringed instrument body of claim 13, wherein the back body includes a corresponding tone block on an inner side of the back body, and when the top body and the back body are joined together, the tone block of the top body is in contact with the corresponding tone block of the back body.

15. The stringed instrument body of claim 13, wherein the tone block of the top body includes a recessed region structured and arranged to accommodate a neck plate and fasteners.

16. The stringed instrument body of claim 1, wherein the back body includes a tone block extending along the length of the back body on an inner side of the back body, and projects along a length of the tone block to a same height in a thickness direction of the back body as a height of a recessed shelf of the shelf/groove engagement structure.

17. The stringed instrument body of claim 1, wherein the top body and the back body have congruent profiles.

18. The stringed instrument body of claim 1, wherein inner sides of at least one of the top body and the back body include one or more hollowed regions.

19. The stringed instrument body of claim 18, further comprising at least one removable insert structured and arranged to be insertable into a hollowed region of the one or more hollowed regions.

20. The stringed instrument body of claim 1, further comprising a neck plate arranged on an inner side of the top body, and structured and arranged for securing a bolt-on neck to the top body.

21. The stringed instrument body of claim 20, wherein when the back body is attached to the top body, the neck plate is covered by the back body, such that the neck plate is internal to the stringed instrument body and hidden from view.

22. The stringed instrument body of claim 20, wherein the inner side of the top body includes a recessed region structured and arranged to accommodate the neck plate.

23. The stringed instrument body of claim 20, wherein the back body accommodates a sculpted region in a neck joint area covering the neck plate.

24. The stringed instrument body of claim 1, wherein the shelf/groove engagement structure of the top body is arranged along the perimeter of the top body, and the shelf/groove engagement structure of the back body is arranged along the perimeter of the back body.

25. The stringed instrument body of claim 1, wherein the top body comprises a neck pocket having a depth D of approximately 0.32" and a length L of approximately 3.2" to 3.5".

26. The stringed instrument body of claim 25, wherein when a neck having a fret board with an approximate height of 1.0" is arranged in the neck pocket, a top surface of the neck is raised above a top surface of the top body by approximately 0.70"-0.90".

27. The stringed instrument body of claim 1, wherein the top body comprises a neck pocket having a length L of approximately 3.2" to 3.5" and a depth D that varies between approximately 0.236" (6 mm) and 0.334" (8.5 mm) along the length of the neck pocket.

28. The stringed instrument body of claim 1, further comprising a bridge assembly having a bridge, mounting posts, and respective stands having conical profile.

29. A stringed instrument, comprising:

the stringed instrument body of claim 6 a neck attached to the top body; and a plurality of strings attached to the neck and the stringed instrument body, wherein the top body is a playable instrument even while the back body is not attached to the top body.

30. A stringed instrument body, comprising:

a top body having a groove/shelf engagement structure;

a neck plate arranged on an inner side of the top body, and structured and arranged for securing a bolt-on neck to the top body; and a back body having a corresponding shelf/groove engagement structure that is engagable with the groove/shelf engagement structure of the top body;

wherein the back body is removably fastenable to the top body, wherein when the corresponding shelf/groove engagement structure is engaged with the groove/shelf engagement structure, a projecting portion of the groove/shelf engagement structure of the top body projects within the back body and contacts a corresponding recessed portion of the shelf/groove engagement structure of the back body, wherein when the back body is fastened to the top body, the neck plate is covered by the back body, such that the neck plate is hidden from view, and wherein the top body has an approximate thickness of A, the back body has an approximate thickness of B, and when the top body is joined to the back body to form the stringed instrument body, the overall thickness of the stringed instrument body is less than A+B.

* * * * *